US011380249B2

(12) United States Patent
Yun et al.

(10) Patent No.: US 11,380,249 B2
(45) Date of Patent: Jul. 5, 2022

(54) DISPLAY DEVICE AND DRIVING METHOD THEREOF

(71) Applicant: Samsung Display Co., Ltd., Yongin-Si (KR)

(72) Inventors: Eun Sil Yun, Hwaseong-si (KR); Sangan Kwon, Cheonan-si (KR); Soon-Dong Kim, Osan-si (KR); Taehoon Kim, Hwaseong-si (KR); Bonghyun You, Seoul (KR); Changnoh Yoon, Seoul (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/228,842

(22) Filed: Apr. 13, 2021

(65) Prior Publication Data

US 2022/0068195 A1 Mar. 3, 2022

(30) Foreign Application Priority Data

Sep. 2, 2020 (KR) ..... 10-2020-0111937

(51) Int. Cl.
*G09G 3/32* (2016.01)

(52) U.S. Cl.
CPC ..... *G09G 3/32* (2013.01); *G09G 2310/0278* (2013.01); *G09G 2310/08* (2013.01); *G09G 2330/021* (2013.01)

(58) Field of Classification Search
CPC ..... G09G 2310/08; G09G 2310/0278; G09G 2330/021; G09G 3/32
See application file for complete search history.

(56) References Cited

U.S. PATENT DOCUMENTS 10,971,077 B2 4/2021 Kwon et al.
2011/0141164 A1* 6/2011 Kimura ..... H01L 27/3216 345/690
2017/0206837 A1* 7/2017 Jeon ..... G09G 3/3225
2020/0265778 A1* 8/2020 Lee ..... G09G 3/32

FOREIGN PATENT DOCUMENTS

KR 10-2016-0022450 A 3/2016
KR 10-2020-0010689 A 1/2020
KR 10-2021-0016123 A 2/2021

* cited by examiner

*Primary Examiner* — Muhammad N Edun
(74) *Attorney, Agent, or Firm* — Innovation Counsel LLP

(57) ABSTRACT

Provided is a display device including a display panel, a data driving circuit configured to drive a plurality of data lines, a scan driving circuit configured to drive a plurality of scan lines, and a driving controller configured to determine an operation mode based on an input signal, and configured to control the data driving circuit and the scan driving circuit in order to drive a first display region of the display panel at a first driving frequency and drive a second display region of the display panel at a second driving frequency while the operation mode is a multi-frequency mode, wherein the driving controller may change the operation mode to a compensation mode in which the second display region is periodically driven at the first driving frequency when the duration of the multi-frequency mode is greater than a reference time.

20 Claims, 17 Drawing Sheets

DISPLAY DEVICE AND DRIVING METHOD THEREOF

CROSS-REFERENCE TO RELATED APPLICATIONS

This U.S. non-provisional patent application claims priority under 35 U.S.C. § 119 of Korean Patent Application No. 10-2020-0111937, filed on Sep. 2, 2020, the entire contents of which are hereby incorporated by reference.

BACKGROUND

1. Field

The present disclosure generally relates to a display device. More particularly, the present disclosure relates to a display device capable of reducing power consumption and preventing display quality degradation, and a driving method thereof.

2. Description of Related Art

Among display devices, an organic light emitting display device displays an image using an organic light emitting diode which generates light by recombination of electrons and holes. Such an organic light emitting display device has advantages of having fast response speed and being driven with low power consumption.

An organic light emitting display device is provided with pixels connected to data lines and scan lines. The pixels usually include an organic light emitting diode and a circuit for controlling the amount of current flowing into the organic light emitting diode. The circuit controls the amount of current flowing from a first driving voltage to a second driving voltage via the organic light emitting diode in correspondence to a data signal. At this time, in correspondence to the amount of the current flowing through the organic light emitting diode, light with a predetermined luminance is generated.

Recently, a display device is used in various fields. Therefore, a plurality of different images may be simultaneously displayed on a single display device. There is need for a technology capable of preventing display quality degradation while reducing the power consumption of a display device on which a plurality of images are simultaneously displayed.

SUMMARY

The present disclosure provides a display device capable of reducing power consumption and preventing display quality degradation, and a driving method thereof.

An embodiment of the present disclosure provides a display device including a display panel including a plurality of pixels respectively connected to a plurality of data lines and a plurality of scan lines, a data driving circuit configured to drive the plurality of data lines, a scan driving circuit configured to drive the plurality of scan lines, and a driving controller configured to determine an operation mode based on an input signal, and configured to control the data driving circuit and the scan driving circuit in order to drive a first display region of the display panel at a first driving frequency and drive a second display region of the display panel at a second driving frequency while the operation mode is a multi-frequency mode. In an embodiment, the driving controller may change the operation mode to a compensation mode in which the second display region is periodically driven at the first driving frequency when a duration of the multi-frequency mode is greater than a reference time.

In an embodiment, the driving controller may control the data driving circuit and the scan driving circuit to drive each of the first display region and the second display region at a normal frequency while the operation mode is a normal mode.

In an embodiment, the first driving frequency may be the same as the normal frequency.

In an embodiment, the driving controller may include a frequency mode determination part configured to determine an operation mode based on the input signal including an image signal and a control signal, and to output a mode signal, and may include a signal generator configured to output a data control signal and a scan control signal corresponding to the mode signal, wherein the data control signal may be provided to the data driving circuit, and the scan control signal may be provided to the scan driving circuit.

In an embodiment, when the duration of the multi-frequency mode is greater than a first reference time, the frequency mode determination part may determine the operation mode as a first compensation mode in which the second display region is periodically driven at the first driving frequency, and the scan driving circuit may generate scan signals to be provided to the plurality of scan lines in response to the scan control signal, wherein a scan signal provided to a scan line corresponding to the second display region among the plurality of scan lines during the first compensation mode may include a low-frequency period and a first compensation period.

In an embodiment, the first compensation period may include a first period and a second period, a driving frequency of the scan signal during the first period of the first compensation period may be the first driving frequency, and the scan signal may be maintained at an inactive level during the second period of the first compensation period.

In an embodiment, the driving frequency of the scan signal during the low-frequency period may be the second driving frequency.

In an embodiment, when the duration of the multi-frequency mode is greater than a second reference time, the frequency mode determination part may determine the operation mode as a second compensation mode in which the second display region is periodically driven at the first driving frequency, and a scan signal provided to a scan line corresponding to the second display region among the plurality of scan lines during the second compensation mode may include a low-frequency period and a second compensation period.

In an embodiment, the second reference time may be greater than the first reference time, and in the scan signal, a repetition period of the second compensation period may be shorter than a repetition period of the first compensation period.

In an embodiment, when the duration of the multi-frequency mode is greater than a third reference time, the frequency mode determination part may determine the operation mode as a third compensation mode in which the second display region is periodically driven at the first driving frequency, and a scan signal provided to a scan line corresponding to the second display region among the plurality of scan lines during the third compensation mode may include a low-frequency period and a third compensation period.

In an embodiment, the third reference time may be greater than the second reference time, and in the scan signal, a repetition period of the third compensation period may be shorter than a repetition period of the first compensation period.

In an embodiment, the second compensation period may include a first period and a second period, the third compensation period may include a third period and a fourth period, in each of the first period of the second compensation period and the third period of the third compensation period, a driving frequency of the scan signal may be the first driving frequency, in each of the second period of the second compensation period and the fourth period of the third compensation period, the scan signal may be maintained at an inactive level, and the third period of the third compensation period may have a longer time than the first period of the second compensation period.

In an embodiment, the input signal may include an image signal and a control signal.

In an embodiment of the present disclosure, a display device includes a display panel having a first non-folding region, a folding region, and a second non-folding region which are defined on a plane and including a plurality of pixels each connected to a plurality of data lines and a plurality of scan lines, a data driving circuit configured to drive the plurality of data lines, a scan driving circuit configured to drive the plurality of scan lines, and a driving controller configured to determine an operation mode based on an input signal, and configured to control the data driving circuit and the scan driving circuit in order to drive a first display region of the display panel at a first driving frequency and drive a second display region of the display panel at a second driving frequency while the operation mode is a multi-frequency mode. In an embodiment, the driving controller may change the operation mode to a compensation mode in which the second display region is periodically driven at the first driving frequency when a duration of the multi-frequency mode is greater than a reference time.

In an embodiment, the first non-folding region may correspond to the first display region, the second non-folding regions may correspond to the second display region, and a first portion of the folding region may correspond to the first display region and a second portion thereof may correspond to the second display region.

In an embodiment, the scan driving circuit may generate scan signals to be provided to the plurality of scan lines in response to the a control signal, wherein a scan signal provided to a scan line corresponding to the second display region among the plurality of scan lines during the compensation mode may include a low-frequency period and a compensation period.

In an embodiment, the compensation period may include a first period and a second period, the driving frequency of the scan signal during the first period of the compensation period may be the first driving frequency, the scan signal is maintained at an inactive level during the second period of the compensation period, and the driving frequency of the scan signal during the low-frequency period may be the second driving frequency.

In an embodiment of the present disclosure, a method for driving a display device includes determining an operation mode based on an input signal, driving a first display region at a first driving frequency such that a moving image is displayed in the first display region of a display panel and driving a second display region at a second driving frequency such that a still image is displayed in the second display region of the display panel while the operation mode is a multi-frequency mode, counting a duration of the multi-frequency mode, and changing the operation mode to a first compensation mode in which the second display region is periodically driven at the first driving frequency when the duration is greater than a first reference time.

In an embodiment, the method may further include generating scan signals to drive a plurality of scan lines of the display panel in response to an operation mode signal, wherein a scan signal provided to a scan line corresponding to the second display region among the plurality of scan lines during the first compensation mode may include a low-frequency period and a first compensation period.

In an embodiment, the first compensation period may include a first period and a second period, a driving frequency of the scan signal during the first period of the first compensation period may be the first driving frequency, and the scan signal may be maintained at an inactive level during the second period of the first compensation period.

BRIEF DESCRIPTION OF THE FIGURES

The accompanying drawings are included to provide a further understanding of the present disclosure, and are incorporated in and constitute a part of this specification. The drawings illustrate example embodiments of the present disclosure and, together with the description, serve to explain principles of the present disclosure. In the drawings.

DETAILED DESCRIPTION

Figure 1:
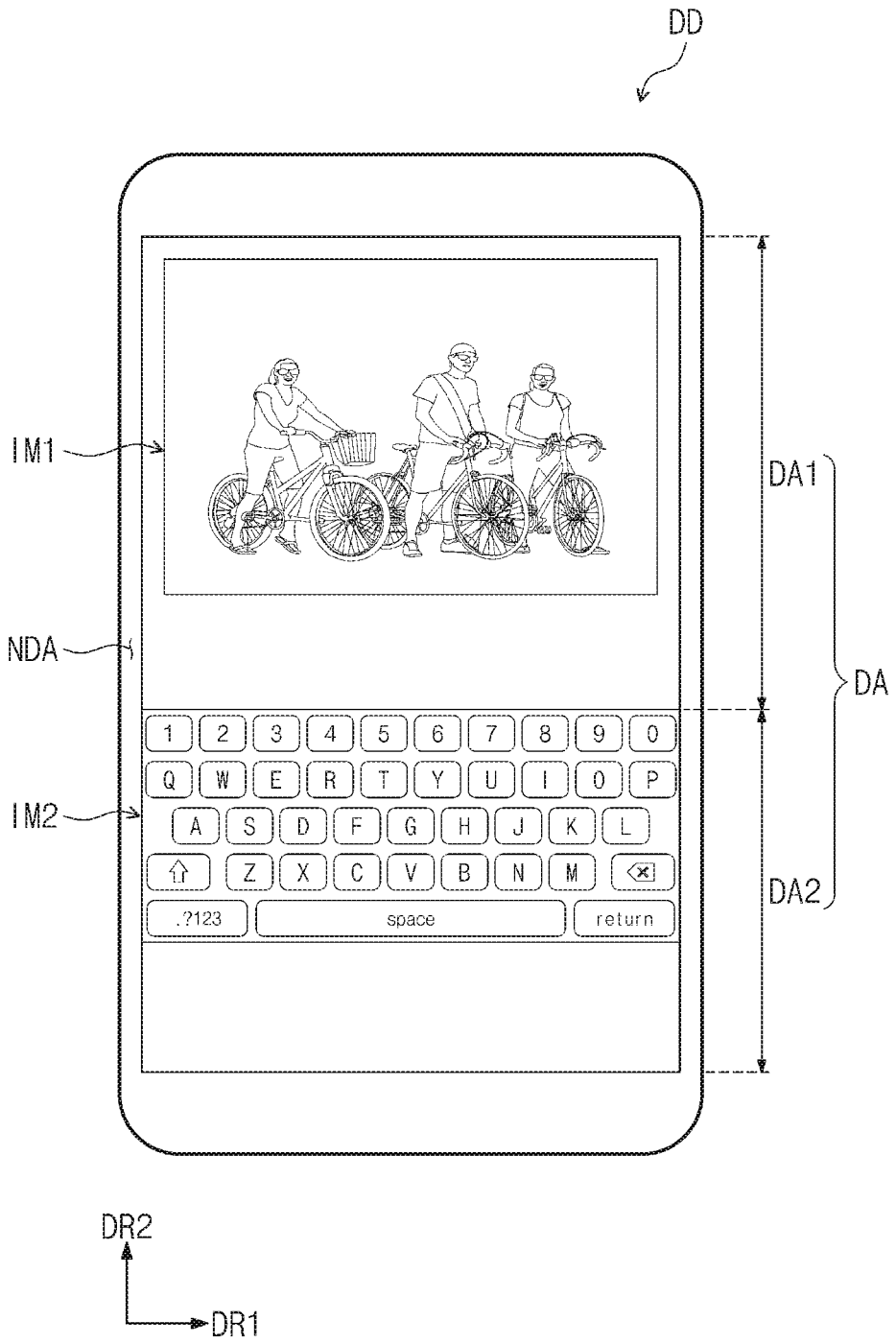
FIG. 1 is a perspective view of a display device according to an embodiment of the present disclosure.

In the present disclosure, when an element (or a region, a layer, a portion, etc.) is referred to as being "on," "connected to," or "coupled to" another element, it means that the element may be directly disposed on/connected to/coupled to the other element, or that a third element may be disposed therebetween.

Like reference numerals refer to like elements. Also, in the drawings, the thickness, the ratio, and the dimensions of elements are exaggerated for an effective description of technical contents. The term "and/or," includes all combinations of one or more of which associated configurations may define.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present disclosure. The terms of a singular form may include plural forms unless the context clearly indicates otherwise.

In addition, terms such as "below," "lower," "above," "upper," and the like are used to describe the relationship of the configurations shown in the drawings. The terms are used as a relative concept and are described with reference to the direction indicated in the drawings.

It should be understood that the terms "comprise", or "have" are intended to specify the presence of stated features, integers, steps, operations, elements, components, or combinations thereof in the disclosure, but do not preclude the presence or addition of one or more other features, integers, steps, operations, elements, components, or combinations thereof.

Unless otherwise defined, all terms (including technical and scientific terms) used herein have the same meaning as commonly understood by one of ordinary skill in the art to which the present disclosure pertains. It is also to be understood that terms defined in commonly used dictionaries should be interpreted as having meanings consistent with the meanings in the context of the related art, and are expressly defined herein unless they are interpreted in an ideal or overly formal sense.

Hereinafter, example embodiments of the present disclosure will be described with reference to the accompanying drawings.

FIG. 1 is a perspective view of a display device according to an embodiment of the present disclosure.

Referring to FIG. 1, as an example of a display device DD according to an embodiment of the present disclosure, a portable terminal is illustrated. The portable terminal may include a tablet PC, a smart phone, a personal digital assistant (PDA), a portable multimedia player (PMP), a game console, a wristwatch-type electronic device, and the like. However, the embodiment of the present disclosure is not limited thereto. The present disclosure may be used for large electronic devices such as a television or an external advertisement board, and also for small and medium-sized electronic devices such as a personal computer, a laptop computer, a kiosk, a car navigation system unit, and a camera. It should be understood that these are merely example embodiments and may be employed in other electronic devices without departing from the present disclosure.

As illustrated in FIG. 1, a display surface on which a first image IM1 and a second image IM2 are displayed is parallel to a plane defined by a first direction DR1 and a second direction DR2. The display device DD includes a plurality of regions separated on the display surface. The display surface includes a display region DA in which the first image IM1 and the second image IM2 are displayed and a non-display region NDA adjacent to the display region DA. The non-display region NDA may be referred to as a bezel region. As an example, the display region DA may have a quadrangular shape. The non-display region NDA surrounds the display region DA. In addition, although not shown, as one example, the display device DD may include a partially curved shape. As a result, one region of the display device DD may have a curved shape.

The display region DA of the display device DD includes a first display region DA1 and a second display region DA2. In a specific application program (so-called "APP"), the first image IM1 may be displayed in the first display region DA1, and the second image IM2 may be displayed in the second display region DA2. For example, the first image IM1 may be a moving image, and the second image IM2 may be a still image or text information having a long change period. However, in another example, the first image IM1 may a still image, and the second image IM2 may be a moving image.

The display device DD according to an embodiment may drive the first display region DA1 in which a moving image is displayed at a normal frequency, and may drive the second display region DA2 in which a still image is displayed at a frequency lower than the normal frequency. The display device DD may reduce power consumption by lowering the driving frequency of the second display region DA2.

The size of each of the first display region DA1 and the second display region DA2 may be a preset size, and may be changed by an application program. In an embodiment, when the first display region DA1 displays a still image and the second display region DA2 displays a moving image, the first display region may be driven at a lower frequency and the second display region DA2 may be driven at a normal frequency. In addition, the display region DA may be divided into three or more display regions, and according to the type of an image (still image or moving image) displayed in each of the display regions, a driving frequency of each of the display regions may be determined.

Figure 2A:
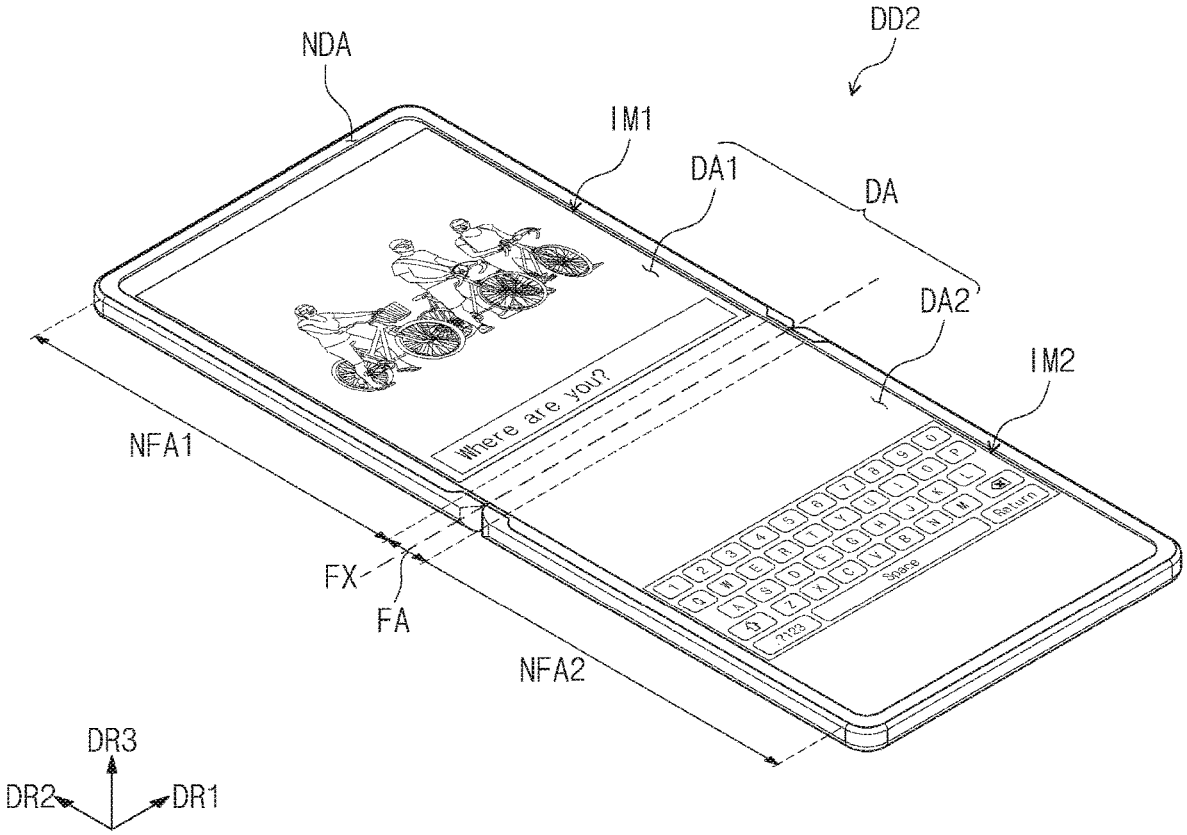
FIG. 2A and FIG. 2B are perspective views of a display device according to an embodiment of the present disclosure.
Figure 2B:
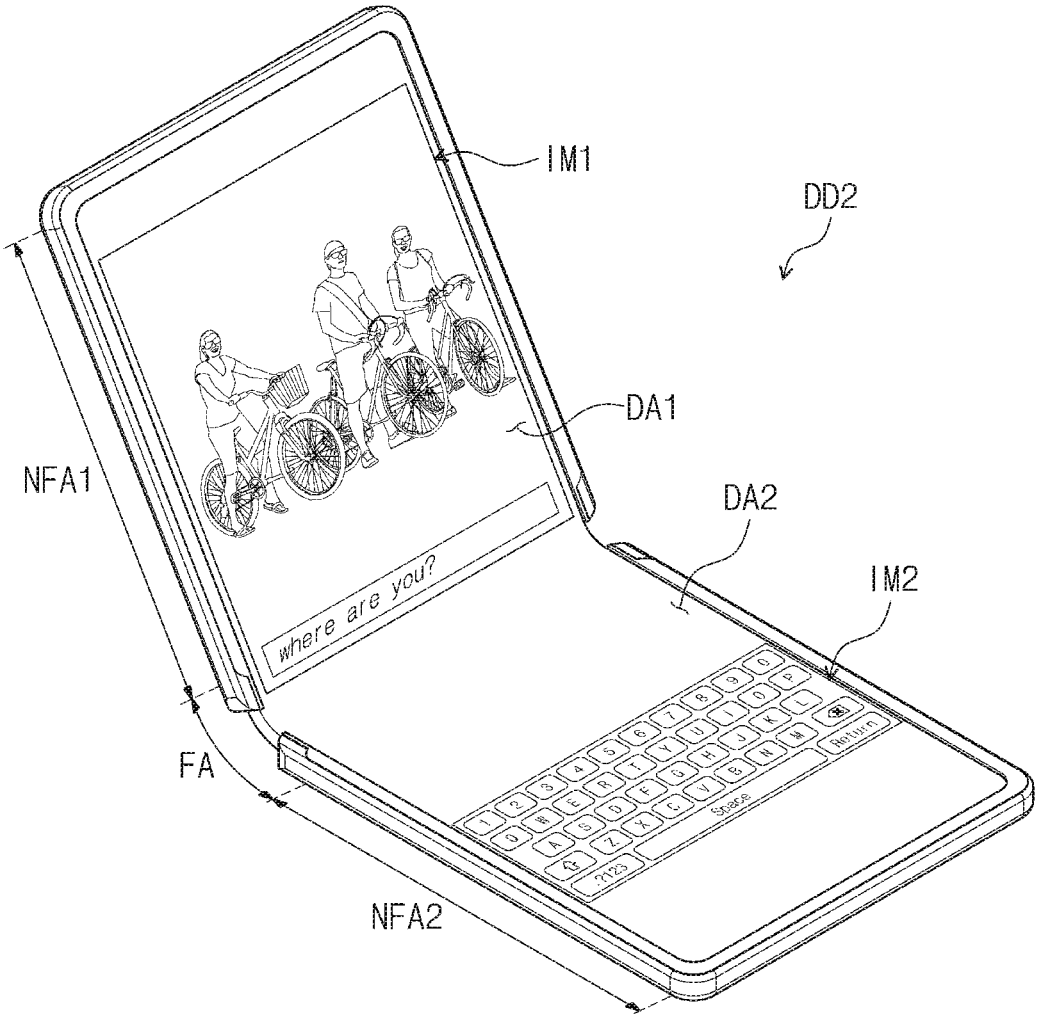

FIG. 2A and FIG. 2B are perspective views of a display device DD2 according to an embodiment of the present disclosure. FIG. 2A illustrates the display device DD2 in an unfolded state, and FIG. 2B illustrates the display device DD2 in a folded state.

As illustrated in FIG. 2A and FIG. 2B, the display device DD2 includes a display area DA and a no-display area NDA. The display device DD2 may display an image through the display region DA. When the display device DD2 is an unfolded state, the display region DA may include a plane defined by a first direction DR1 and a second direction DR2. The thickness direction of the display device DD2 may be parallel to a third direction DR3 intersecting the first direction DR1 and the second direction DR2. Therefore, a front surface (or an upper surface) and a rear surface (or a lower surface) of members constituting the display device DD2 may be defined on the basis of the third direction DR3. The non-display region NDA may be referred to as a bezel region. As an example, the display region DA may have a quadrangular shape. The non-display region NDA surrounds the display region DA.

The display region DA may include a first non-folding region NFA1, a folding region FA, and a second non-folding region NFA2. The folding region FA may be bent on the basis of a folding axis FX extending along the first direction DR1.

When the display device DD2 is folded, the first non-folding region NFA1 and the second non-folding region NFA2 may face each other. Therefore, in a completely folded state, the display region DA may not be exposed to the outside, which may be referred to as in-folding. However, this is only example. The operation of the display device DD2 is not limited thereto.

For example, in an embodiment of the present disclosure, when the display device DD2 is folded, the first non-folding region NFA1 and the second non-folding region NFA2 may oppose each other. Therefore, in a folded state, the first non-folding region NFA1 may be exposed to the outside, which may be referred to as out-folding.

The display device DD2 may perform either an in-folding operation or an out-folding operation. Alternatively, the display device DD2 may perform both an in-folding operation and an out-folding operation. In this case, the same region of the display device DD2, for example, the folding region FA may be in-folded and out-folded. Alternatively, some portions of the display device DD2 may be in-folded, and the other regions thereof may be out-folded.

In FIG. 2A and FIG. 2B, one folding region and two non-folding regions are illustrated as an example. However, the number of folding regions and non-folding regions is not limited thereto. For example, the display device DD2 may include a plurality of non-folding regions, which is more than two, and a plurality of folding regions disposed between non-folding regions adjacent to each other.

In FIG. 2A and FIG. 2B, the folding axis FX is illustrated as being parallel to a short axis of the display device DD2, but the present disclosure is not limited thereto. For example, the folding axis FX may extend along a long axis of the display device DD2, for example, a direction parallel to the second direction DR2. In this case, the first non-folding region NFA1, the folding region FA, and the second non-folding region NFA2 may be sequentially arranged along the first direction DR1.

In the display region DA of the display device DD2, a plurality of display regions DA1 and DA2 may be defined. In FIG. 2A, two display regions DA1 and DA2 are illustrated. However, the number of the plurality of display regions DA1 and DA2 is not limited thereto.

The plurality of display regions DA1 and DA2 may include a first display region DA1 and a second display region DA2. For example, the first display region DA1 may be a region in which a first image IM1 is displayed, and the second display region DA2 may be a region in which a second image IM2 is displayed. However, the embodiment of the present disclosure is not limited thereto. For example, the first image IM1 may be a moving image, and the second image IM2 may be a still image or an image (text information, etc.) having a long change period.

The display device DD2 according to an embodiment may operate differently according to an operation mode. The operation mode may include a normal mode and a multi-frequency mode. In the normal mode, the display device DD2 may drive both the first display region DA1 and the second display region DA2 at a normal frequency. In the multi-frequency mode, the display device DD2 according to an embodiment may drive the first display region DA1 in which the first image IM1 is displayed at a first driving frequency and may drive the second display region DA2 in which the second image IM2 is displayed at a second driving frequency which is lower than the normal frequency. In an embodiment, the first driving frequency may be the same as the normal frequency.

The size of each of the first display region DA1 and the second display region DA2 may be predetermined, and may be changed by an application program. In an embodiment, the first display region DA1 may correspond to the first non-folding region NFA1 and the second display region DA2 may correspond to the second non-folding region NFA2. In addition, a first portion of the folding region FA may correspond to the first display region DA1 and a second portion of the folding region FA may correspond to the second display region DA2.

In an embodiment, the folding region FA may all correspond to either the first display region DA1 or the second display region DA2.

In an embodiment, the first display region DA1 may correspond to a first portion of the first non-folding region NFA1 and the second display region DA2 may correspond to a second portion of the first non-folding region NFA1, the folding region FA, and the second non-folding region NFA2. That is, the area of the first display region DA1 may be greater than the area of the second display region DA2.

In an embodiment, the first display region DA1 may correspond to the first non-folding region NFA1, the folding region FA, and a first portion of the second non-folding region NFA2, and the second display region DA2 may correspond to a second portion of the second non-folding region NFA2. That is, the area of the second display region DA2 may be greater than the area of the first display region DA1.

As illustrated in FIG. 2B, when the folding region FA is in a folded state, the first display region DA1 may correspond to the first non-folding region NFA1 and the second display region DA2 may correspond to the second non-folding region NFA2.

In FIG. 2A and FIG. 2B, the display device DD2 having one folding region is illustrated as an example of a display device. However, the embodiment of the present disclosure is not limited thereto. For example, the present disclosure may be applied to a display device having two or more folding regions, a rollable display device, a slidable display, or the like. In another example, a display device may have a first folding region and a second folding region which crosses the first folding region.

In the following description, the display device DD illustrated in FIG. 1 will be described as an example. However, the same may be applied to the display device DD2 illustrated in FIG. 2A and FIG. 2B.

Figure 3A:
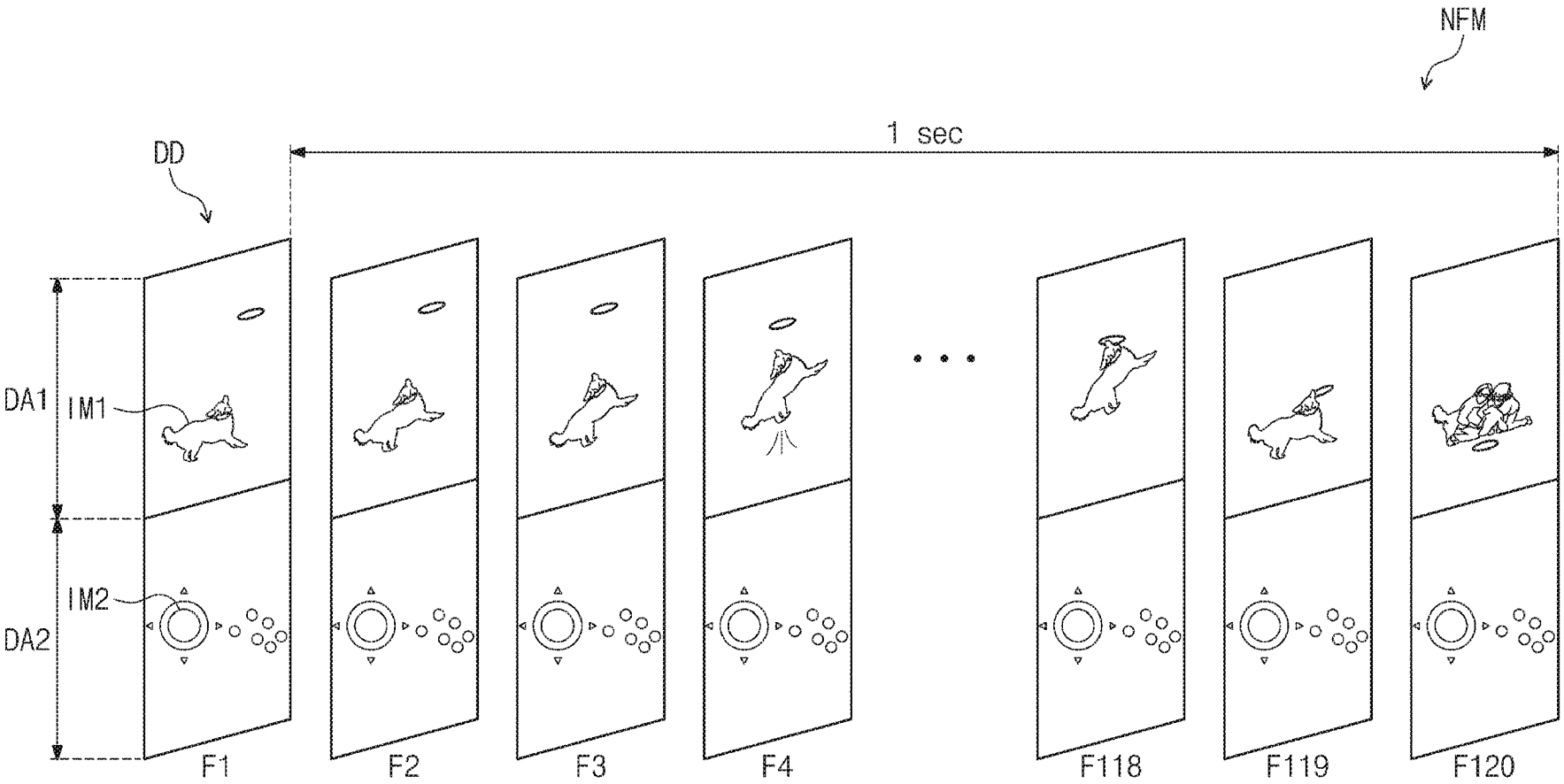
FIG. 3A is a view for describing the operation of a display device in a normal mode.
Figure 3B:
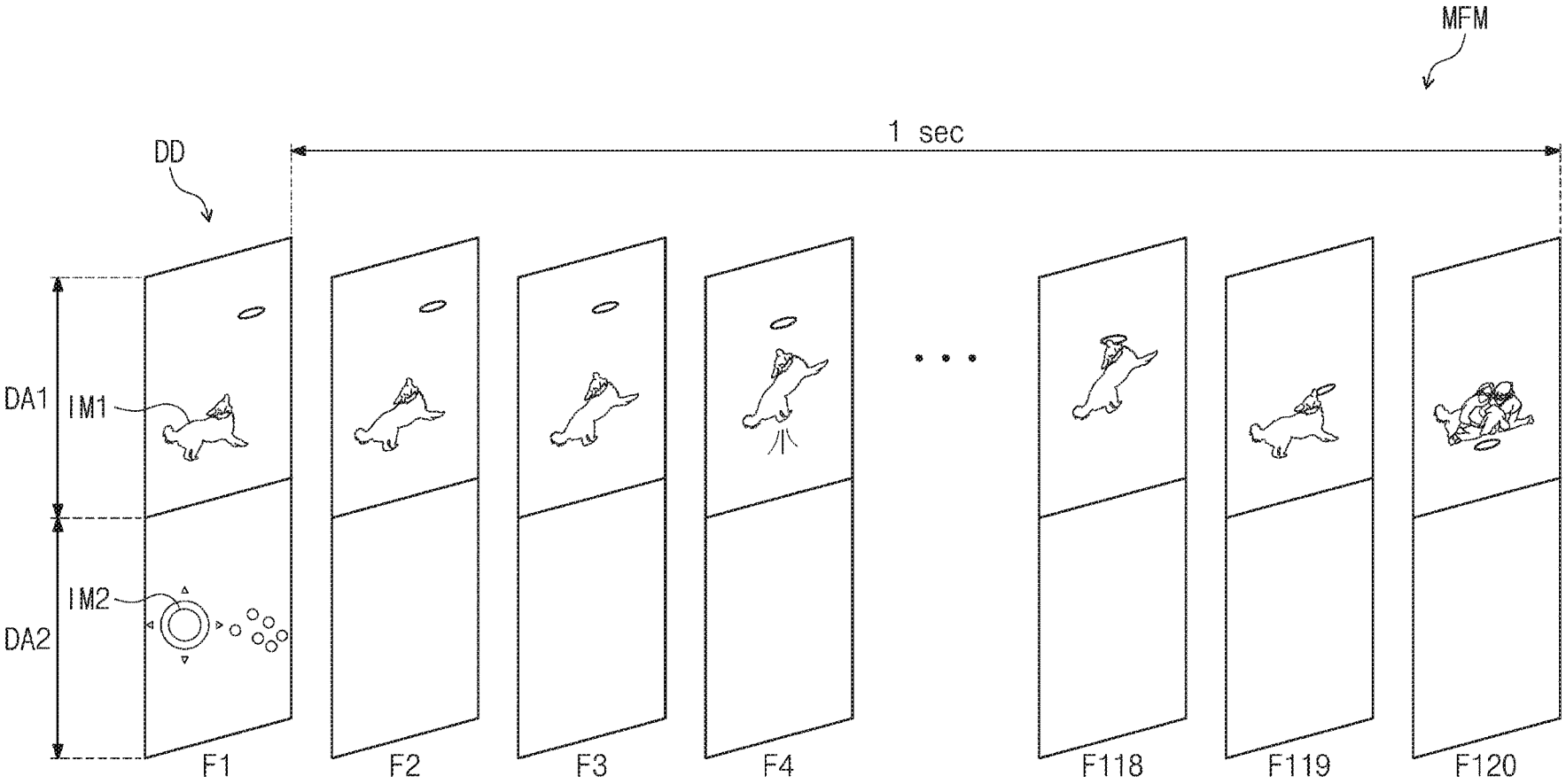
FIG. 3B is a view for describing the operation of a display device in a multi-frequency mode.

FIG. 3A is a view for describing the operation of a display device in a normal mode. FIG. 3B is a view for describing the operation of a display device in a multi-frequency mode.

Referring to FIG. 3A, the first image IM1 to be displayed in the first display region DA1 may be a moving image, and the second image IM2 to be displayed in the second display region DA2 may be a still image or an image (for example, a keypad for game operation) having a long change period. The first image IM1 to be displayed in the first display region DA1 and the second image IM2 to be displayed in the second display region DA2 illustrated in FIG. 1 are only example. Various images may be displayed in the display device DD.

In a normal mode NFM, the driving frequency of the first display region DA1 and the second display region DA2 of the display device DD is a normal frequency. For example, the normal frequency may be 120 Hz. In the normal mode NFM, in the first display region DA1 and the second display region DA2 of the display device DD, images of a first frame F1 to a 120-th frame F120 may be displayed for one second.

Referring to FIG. 3B, in a multi-frequency mode MFM, the display device DD may set the driving frequency of the first display region DA1 in which the first image IM1, that is a moving image, is displayed to a first driving frequency, and may set the driving frequency of the second display region DA2 in which the second image IM2, that is a still image, is displayed to a second driving frequency which is lower than the first driving frequency. When the normal frequency is 120 Hz, the first driving frequency may be 120 Hz, and the second driving frequency may be 1 Hz. The first driving frequency and the second driving frequency may vary. For example, the first driving frequency may be 144 Hz, which is higher than the normal frequency, and the second driving frequency may be any one of 60 Hz, 30 Hz, and 10 Hz, which are lower than the normal frequency.

When the first driving frequency is 120 Hz and the second driving frequency is 1 Hz in the multi-frequency mode MFM, in the first display region DA1 of the display device DD, the first image IM1 is displayed for one second in each of the first frame F1 to a 120-th frame F120. The second image IM2 may be displayed only in the first frame F1 in the second display region DA2, and an image may not be displayed in the rest of frames F2 to F120. The operation of the display device DD in the multi-frequency mode MFM will be described in detail later.

In the following description, in order to facilitate understanding, a normal mode will be described as the normal mode NFM, and a multi-frequency mode will be described as the multi-frequency mode MFM.

Figure 4:
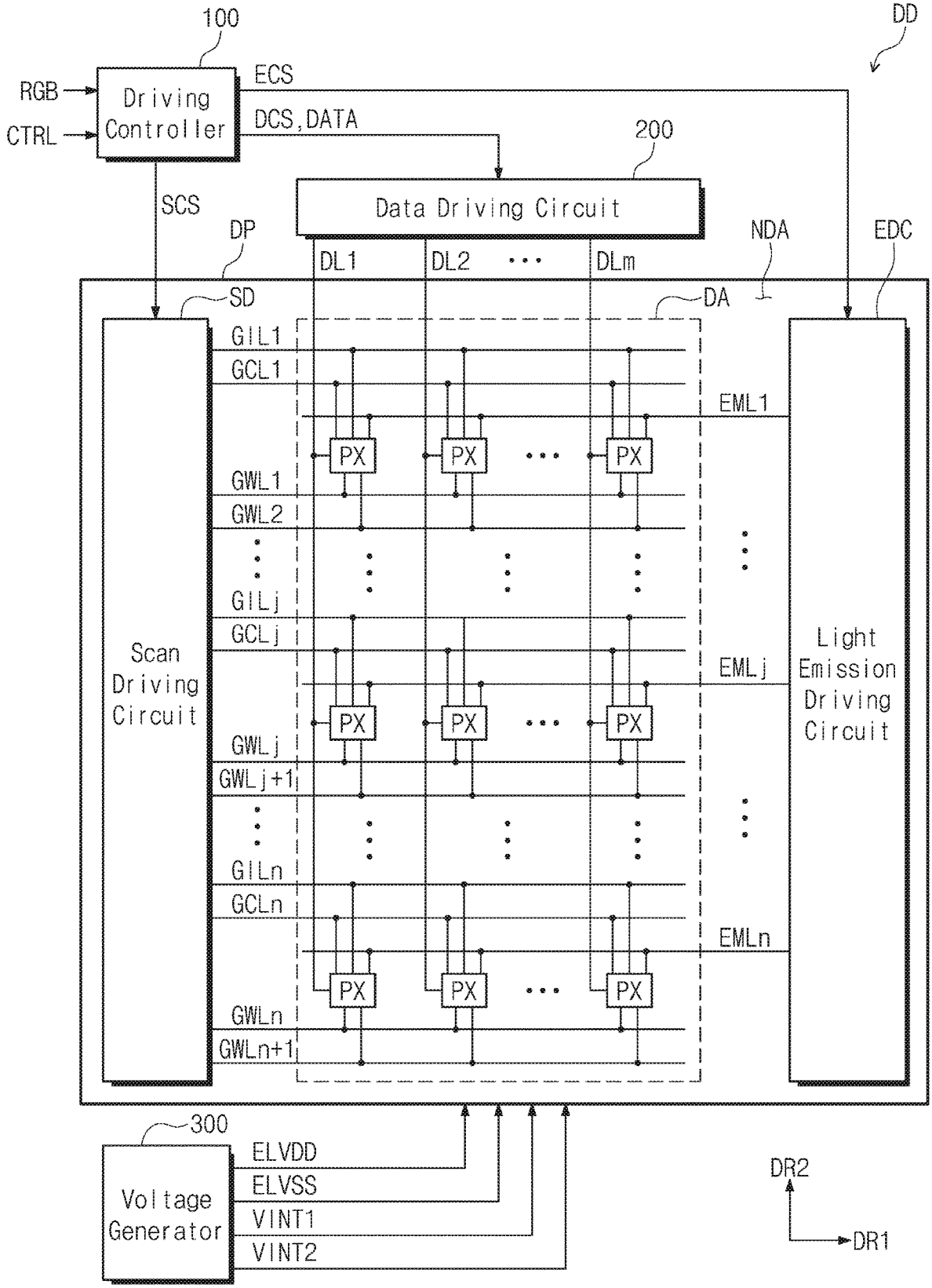
FIG. 4 is a block diagram of a display device according to an embodiment of the present disclosure.

FIG. 4 is a block diagram of a display device according to an embodiment of the present disclosure.

Referring to FIG. 4, the display device DD includes a display panel DP, a driving controller 100, a data driving circuit 200, and a voltage generator 300.

The driving controller 100 receives an input signal including an image signal RGB and a control signal CTRL. The driving controller 100 generates an image data signal DATA obtained by converting the data format of the image signal RGB to meet the interface specifications of the data driving circuit 200. The driving controller 100 outputs a scan control signal SCS, a data control signal DCS, and a light emission control signal ECS.

The data driving circuit 200 receives the data control signal DCS and the image data signal DATA from the driving controller 100. The data driving circuit 200 converts the image data signal DATA into data signals and outputs the data signals to a plurality of data lines DL1 to DLm to be described later. The data signals are analog voltages corresponding to gray scale values of the image data signal DATA.

The voltage generator 300 generates voltages required for the operation of the display panel DP. In this embodiment, the voltage generator 300 generates a first driving voltage ELVDD, a second driving voltage ELVSS, a first initialization voltage VINT1, and a second initial initialization voltage VINT2.

The display panel DP includes scan lines GIL1 to GILn, GCL1 to GCLn, and GWL1 to GWLn+1, light emission control lines EML1 to EMLn, data lines DL1 to DLm, and pixels PX. The display panel DP may further include a scan driving circuit SD and a light emission driving circuit EDC. In an embodiment, the scan driving circuit SD is arranged on a first side of the display panel DP. The scan lines GIL1 to GILn, GCL1 to GCLn, and GWL1 to GWLn+1 are extended in the first direction DR1 from the scan driving circuit SD.

The light emission driving circuit EDC is arranged on a second side of the display panel DP. The light emission control lines EML1 to EMLn are extended from the light emission driving circuit EDC in a direction opposite to the first direction DR1.

The scan lines GIL1 to GILn, GCL1 to GCLn, and GWL1 to GWLn+1 and the light emission control lines EML1 to EMLn are arranged spaced apart from each other in the second direction DR2. The data lines DL1 to DLm are extended from the data driving circuit 200 in a direction opposite to the second direction DR2, and arranged spaced apart from each other in the first direction DR1.

In an example illustrated in FIG. 4, the scan driving circuit SD and the light emission driving circuit EDC are arranged facing each other with the pixels PX interposed therebetween, but the present disclosure is not limited thereto. For example, the scan driving circuit SD and the light emission driving circuit EDC may be disposed adjacent to either the first side or the second side of the display panel DP. In an embodiment, the scan driving circuit SD and the light emission driving circuit EDC may be formed as one circuit.

The plurality of pixels PX are electrically connected to the scan lines GIL1 to GILn, GCL1 to GCLn, and GWL1 to GWLn+1, the light emission control lines EML1 to EMLn, and data lines DL1 to DLm, respectively. Each of the plurality of pixels PX may be electrically connected to four scan lines and one light emission control line. For example, as illustrated in FIG. 4, pixels in a first row may be connected to scan lines GILL GCL1, GWL1, and GWL2, and a light emission control line EML1. In addition, pixels in a second row may be connected to scan lines GL1, GL2, and GL3, and a light emission control line EML2.

Each of the plurality of pixels PX includes a light emitting diode ED (see FIG. 5) and a pixel circuit PXC (see FIG. 5) which controls the light emission of the light emitting diode ED. The pixel circuit PXC may include one or more transistors and one or more capacitors. The scan driving circuit SD and the light emission driving circuit EDC may include transistors formed in the same process as the pixel circuit PXC.

Each of the plurality of pixels PX receives the first driving voltage ELVDD, the second driving voltage ELVSS, the first initialization voltage VINT1, and the second initial initialization voltage VINT2.

The scan driving circuit SD receives the scan control signal SCS from the driving controller 100. The scan driving circuit SD may output scan signals to the scan lines GIL1 to GILn, GCL1 to GCLn, and GWL1 to GWLn+1 in response to the scan control signal SCS. The circuit configuration and operation of the scan driving circuit SD will be described in detail later.

The driving controller 100 according to an embodiment may divide the display panel DP into the first display region DA1 (see FIG. 1) and the second display regions DA2 (see FIG. 1) on the basis of the input signal including the image signal RGB and the control signal CTRL, and may set the driving frequency of the first display region DA1 and of the second display region DA2. For example, the driving controller 100 drives each of the first display region DA1 and the second display region DA2 at a normal frequency (e.g., 120 Hz) in a normal mode. The driving controller 100 may drive the first display region DA1 at a first driving frequency (e.g., 120 Hz), and may drive the second display region DA2 at a low frequency (e.g., 1 Hz) in a multi-frequency mode.

Figure 5:
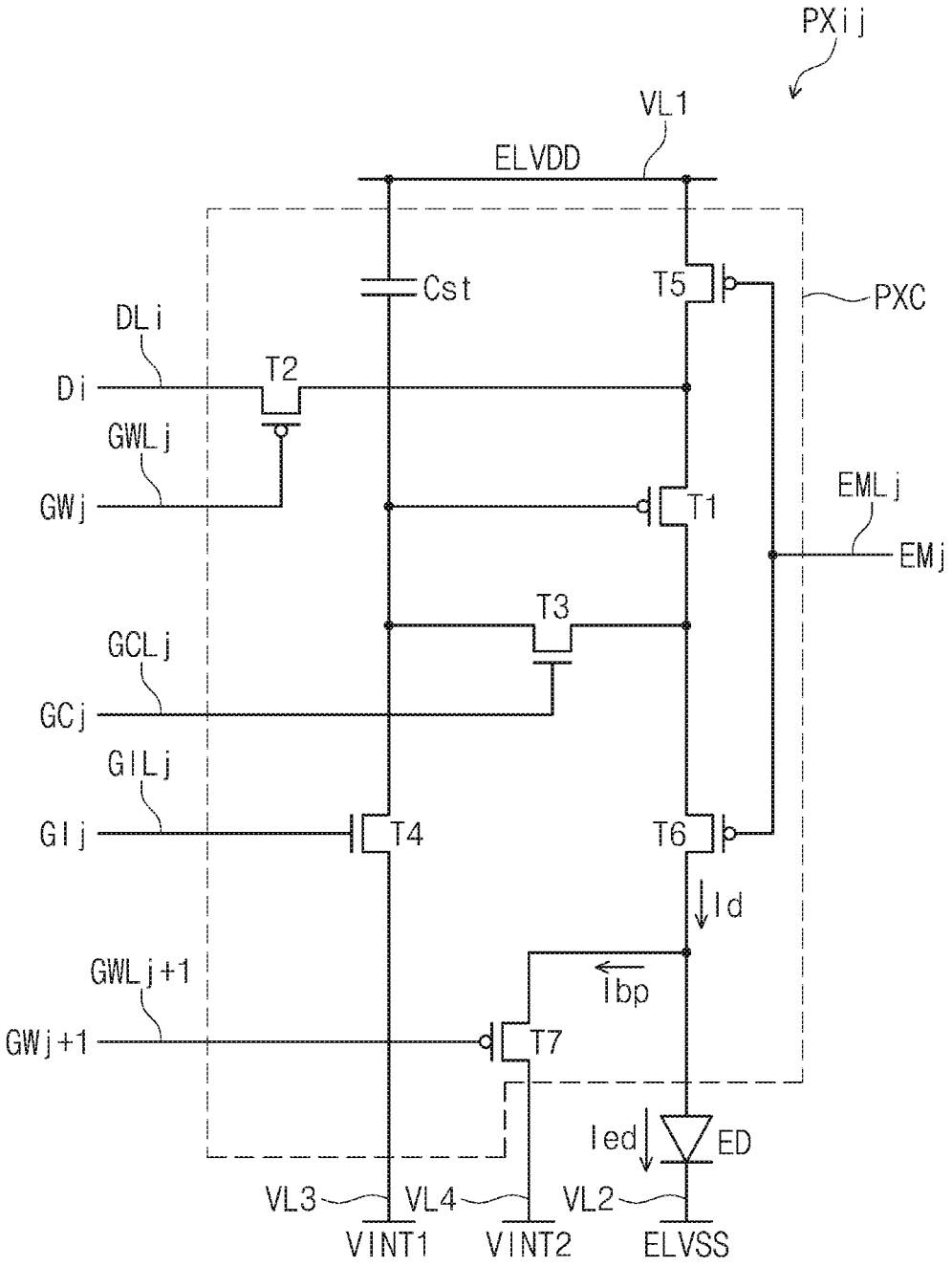
FIG. 5 is an equivalent circuit diagram of a pixel according to an embodiment of the present disclosure.

FIG. 5 is an equivalent circuit diagram of a pixel according to an embodiment of the present disclosure.

FIG. 5 illustrates an equivalent circuit diagram of a pixel PXij connected to an i-th data line DLi among the data lines DL1 to DLm, j-th scan lines GILj, GCLj, and GWLj among scan lines GL0 to GLn+1, a j+1-th scan line GWLj+1, and a j-th light emission control line EMLj among the light emission control lines EML1 to EMLn illustrated in FIG. 4.

Referring to FIG. 5, the pixel PXij of the display device according to an embodiment includes the first to seventh transistors T1, T2, T3, T4, T5, T6, and T7, the capacitor Cst, and at least one light emitting diode ED. In this embodiment, one pixel PXij including one light emitting diode ED will be described as an example.

Each of the plurality of pixels PX illustrated in FIG. 4 may have the same circuit configuration as that shown in the equivalent circuit diagram of the pixel PXij illustrated in FIG. 5. In this embodiment, in the pixel circuit PXC of the pixel PXij, third and fourth transistors T3 and T4 among first to seventh transistors T1 to T7 are each an N-type transistor having an oxide semiconductor as a semiconductor layer, and each of first, second, fifth, sixth, and seventh transistors T1, T2, T5, T6, and T7 is a P-type transistor having a low-temperature polycrystalline silicon (LTPS) semiconductor layer. However the present disclosure is not limited thereto. All of the first to seventh transistors T1, T2, T3, T4, T5, T6, and T7 may be P-type transistors or N-type transistors. In another embodiment, at least one of the first to seventh transistors T1, T2, T3, T4, T5, T6, and T7 may be an N-type transistor and the rest thereof may be a P-type transistor. Also, the circuit configuration of a pixel according to the present disclosure is not limited to what is shown in FIG. 5. The pixel circuit PXC illustrated in FIG. 5 is only example, and the configuration of the pixel circuit PXC may be modified and implemented.

The scan lines GILj, GCLj, GWLj, and GWLj+1 may respectively transmit scan signals GIj, GCj, GWj, and GWj+1, and the light emission control line EMLj may transmit a light emission signal EMj. The data line DLi transmits a data signal Di. The data signal Di may have a voltage level corresponding to the image signal RGB input to the display device DD (see FIG. 4). First to fourth driving voltage lines VL1, VL2, VL3, and VL4 may transmit the first driving voltage ELVDD, the second driving voltage ELVSS, the first initialization voltage VINT1, and the second initialization voltage VINT2.

A first transistor T1 includes a first electrode connected to a first driving voltage line VL1 via a fifth transistor T5, a second electrode electrically connected to an anode of the light emitting diode ED via a sixth transistor T6, and a gate electrode connected to one end of the capacitor Cst. The first transistor T1 may receive the data signal Di transmitted by the data Line DLi in accordance with the switching operation of a second transistor T2 and supply a driving current Id to the light emitting diode ED.

The second transistor T2 includes a first electrode connected to the data line DLi, a second electrode connected to the first electrode of the first transistor T1, and a gate electrode connected to a scan line GWLj. The second transistor T2 may be turned on according to a scan signal GWj received through the scan line GWLj to transmit the data signal Di transmitted from the data line DLi to the first electrode of the first transistor T1.

A third transistor T3 includes a first electrode connected to the gate electrode of the first transistor T1, a second electrode connected to the second electrode of the first transistor T1, and a gate electrode connected to a scan line GCLj. The third transistor T3 may be turned on according to a scan signal GCj received through the scan line GCLj to connect the gate electrode of the first transistor T1 and the second electrode so as to diode connect the first transistor T1.

A fourth transistor T4 includes a first electrode connected to the gate electrode of the first transistor T1, a second electrode connected to a third driving voltage line VL3 through which the first initialization voltage VINT1 is transmitted, and a gate electrode connected to a scan line GILj. The fourth transistor T4 may be turned on according to a scan signal GIj received through the scan line GILj to transmit the first initialization voltage VINT1 to the gate electrode of the first transistor T1 so as to perform an initialization operation to initialize the voltage of the gate electrode of the first transistor T1.

A fifth transistor T5 includes a first electrode connected to the first driving voltage line VL1, a second electrode connected to the first electrode of the first transistor T1, and a gate electrode connected to the light emission control line EMLj.

A sixth transistor T6 includes a first electrode connected to the second electrode of the first transistor T1, a second electrode connected the anode of the light emitting diode ED, and a gate electrode connected to the light emission control line EMLj.

The fifth transistor T5 and the sixth transistor T6 are simultaneously turned on according to the light emission signal EMj received through the light emission control line EMLj, and as a result, the first driving voltage ELVDD may be compensated through the diode-connected first transistor T1 and transmitted to the light emitting diode ED.

A seventh transistor T7 includes a first electrode connected to the second electrode of the sixth transistor T6, a second electrode connected to a fourth voltage line VL4, and a gate electrode connected to the scan line GWLj+1. The seventh transistor T7 is turned on according to a scan signal GWj+1 received through the scan line GWLj+1 to bypass the current of the anode of the light emitting diode ED to the fourth voltage line VL4.

The one end of the capacitor Cst is connected to the gate electrode of the first transistor T1 as described above, and the other end thereof is connected to the first driving voltage line VL1. A cathode of the light emitting diode ED may be connected to a second driving power line VL2 which transmits the second driving voltage ELVSS. The structure of the pixel PXij according to an embodiment is not limited to the structure illustrated in FIG. 5. The number of transistors and the number of capacitors included in one pixel PXij and the connection relationship thereof may be variously modified.

Figure 6:
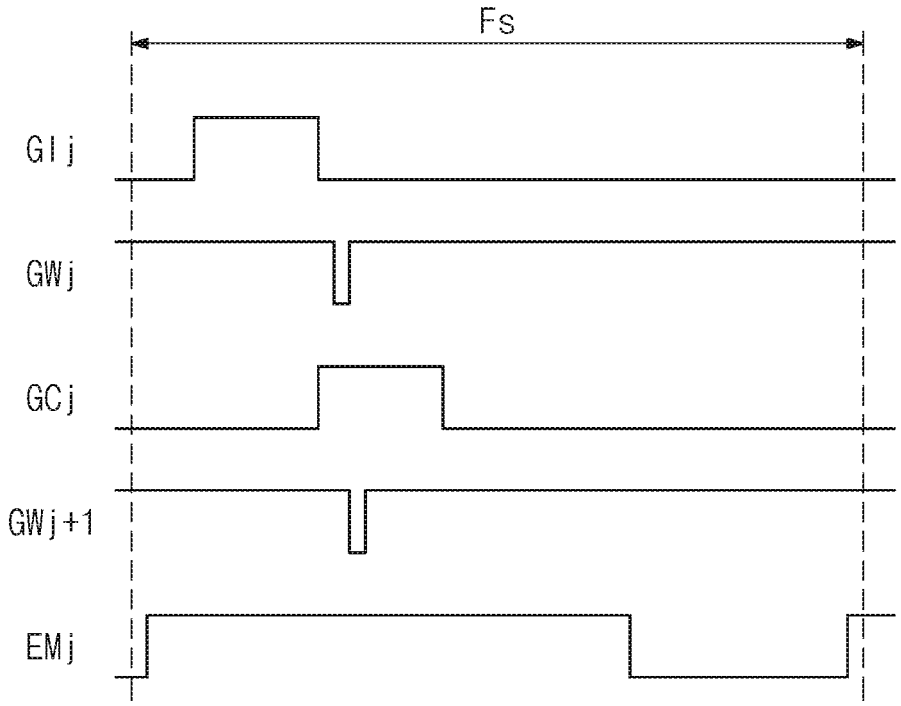
FIG. 6 is a timing diagram for explaining the operation of the pixel illustrated in FIG. 5.

FIG. 6 is a timing diagram for explaining the operation of the pixel illustrated in FIG. 5. Referring to FIG. 5 and FIG. 6, the operation of a display device according to an embodiment will be described.

Referring FIG. 5 and FIG. 6, during an initialization period within one frame FS, the scan signal GIj of a high level is supplied through the scan lines GILj. In response to the scan signal GIj of a high level, the fourth transistor T4 is turned on, and through the fourth transistor T4, the first initialization voltage VINT1 is transmitted to the gate electrode of the first transistor T1 to initialize the first transistor T1.

Next, when the scan signal GCj of a high level is supplied through a scan line GLj during data programming and a compensation period, the third transistor T3 is turned on.

The first transistor T1 is diode-connected by the turned-on third transistor T3, and is biased in a forward direction. In addition, the second transistor T2 is turned on by the scan signal GIj of a low level. Then, a compensation voltage Di-Vth reduced by a threshold voltage Vth of the first transistor T1 from the data signal Di supplied from the data line DLi is applied to the gate electrode of the first transistor T1. That is, a gate voltage applied to the gate electrode of the first transistor T1 may be the compensation voltage Di-Vth.

To both ends of the capacitor Cst, the first driving voltage ELVDD and the compensation voltage Di-Vth are applied, and in the capacitor Cst, electric charges corresponding to the voltage difference between both ends may be stored.

Meanwhile, the seventh transistor T7 is turned on by being supplied with the scan signal GWj+1 of a low level through the scan line GWLj+1. A portion of the driving current Id may exit through the seventh transistor T7 as a bypass current Ibp by the seventh transistor T7.

When the light emitting diode ED emits light even while a minimum current of the first transistor T1 for displaying a black image flows as a driving current, the black image is not properly displayed. Accordingly, the seventh transistor T7 in the pixel PXij according to an embodiment of the present disclosure may direct a portion of the minimum current of the first transistor T1 as the bypass current Ibp to a current path other than a current path on the side of a light emitting diode. Here, the minimum current of the first transistor T1 refers to a current under a condition that the first transistor is turned off since a gate-source voltage Vgs of the first transistor T1 is less than the threshold voltage Vth. As such, the minimum driving current under the condition that the first transistor T1 is turned off (for example, a current of 10 pA or less) is transmitted to the light emitting diode and displayed as an image of black luminance. When the minimum driving current for displaying the black image flows, the effect of the bypass transmission of the bypass current Ibp is significant. However, when a large driving current for displaying an image, such as a normal image or a white image, flows, there is little effect of the bypass current Ibp. Accordingly, when a driving current for displaying a black image flows, a light emitting current Ted of the light emitting diode ED reduced by the amount of current of the bypass current Ibp exiting through the seventh transistor T7 from the driving current Id may have a minimum amount of current to a level so as to reliably display the black image. Accordingly, an image of correct black luminance may be implemented using the seventh transistor T7, so that the contrast ratio may be improved. In this embodiment, a bypass signal is the scan signal GWj+1 of a low level, but the embodiment of the present disclosure is not necessarily limited thereto.

Next, the light emission signal EMj supplied from the light emission control line EMLj during a light emitting period is changed from a high level to a low level. During the light emitting period, the fifth transistor T5 and the sixth transistor T6 are turned on by the light emission signal EMj which is at a low level. Then, the driving current Id corresponding to the voltage difference between the gate voltage of the gate electrode of the first transistor T1 and the first driving voltage ELVDD is generated, and through the sixth transistor T6, the driving current Id is supplied to the light emitting diode ED such that the current Ied flows in the light emitting diode ED.

Figure 7:
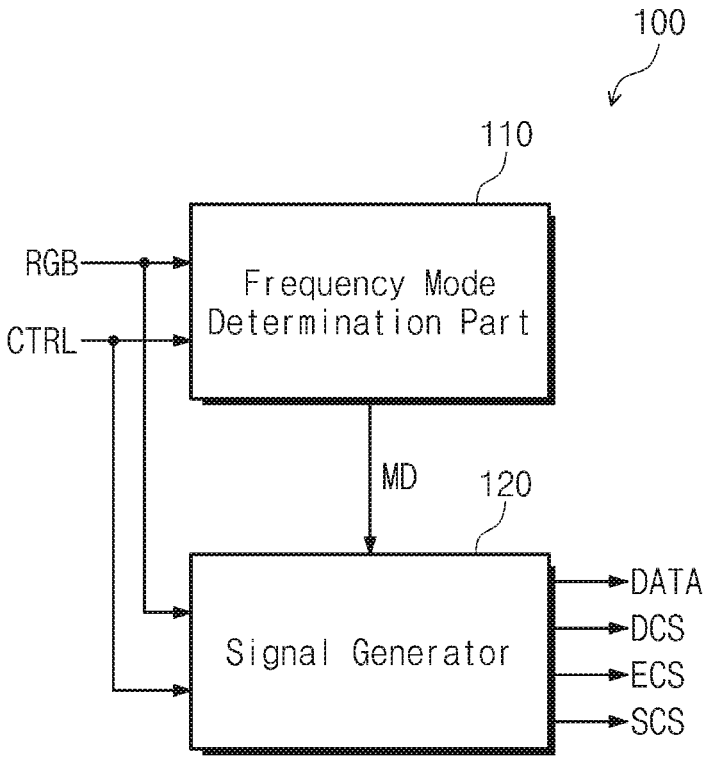
FIG. 7 is a block diagram showing the configuration of a driving controller according to an embodiment of the present disclosure.

FIG. 7 is a block diagram showing the configuration of a driving controller according to an embodiment of the present disclosure.

Referring to FIG. 4 and FIG. 7, a driving controller 100 includes a frequency mode determination part 110 and a signal generator 120. The frequency mode determination part 110 determines a frequency mode in response to the image signal RGB and the control signal CTRL, and outputs a mode signal MD corresponding to the determined frequency mode.

In an example embodiment, the mode signal MD may represent the normal mode NFM, the multi-frequency mode MFM, or a compensation mode. In an embodiment, the compensation mode may include first to third compensation modes. The operation of the frequency mode determination part 110 will be described in detail later.

The signal generator 120 receives the image signal RGB, the control signal CTRL, and the mode signal MD from the frequency mode determination part 110. The signal generator 120 outputs the image data signal DATA, the data control signal DCS, the light emission control signal ECS, and the scan control signal SCS in response to the image signal RGB, the control signal CTRL, and the mode signal MD.

When the mode signal MD represents the normal mode NFM, the signal generator 120 may output the image data signal DATA, the data control signal DCS, the light emission control signal ECS, and the scan control signal SCS to drive each of the first display region DA1 (see FIG. 1) and the second display region DA2 (see FIG. 1) at a normal frequency.

When the mode signal MD represents the multi-frequency mode MFM, the signal generator 120 may output the image data signal DATA, the data control signal DCS, the light emission control signal ECS, and the scan control signal SCS to drive the first display region DA1 at a first driving frequency and to drive the second display region DA2 at a second driving frequency. In an embodiment, the first driving frequency may be the same frequency as the normal frequency. In an embodiment, the first driving frequency may be a frequency higher than the normal frequency. In an embodiment, the second driving frequency may be a frequency lower than the normal frequency.

The signal generator 120 drives the first display region DA1 at the first driving frequency and drives the second display region DA2 at the second driving frequency when the mode signal MD represents a compensation mode, but may output the image data signal DATA, the data control signal DCS, the light emission control signal ECS, and the scan control signal SCS to periodically drive the second display region DA2 at a third driving frequency which is lower than the first driving frequency and higher than the second driving frequency.

The data driving circuit 200, the scan driving circuit SD, and the light emission driving circuit EDC illustrated in FIG. 4 operate in response to the image data signal DATA, the data control signal DCS, the scan control signal SCS, and the light emission control signal ECS such that an image is displayed on the display panel DP.

Figure 8:
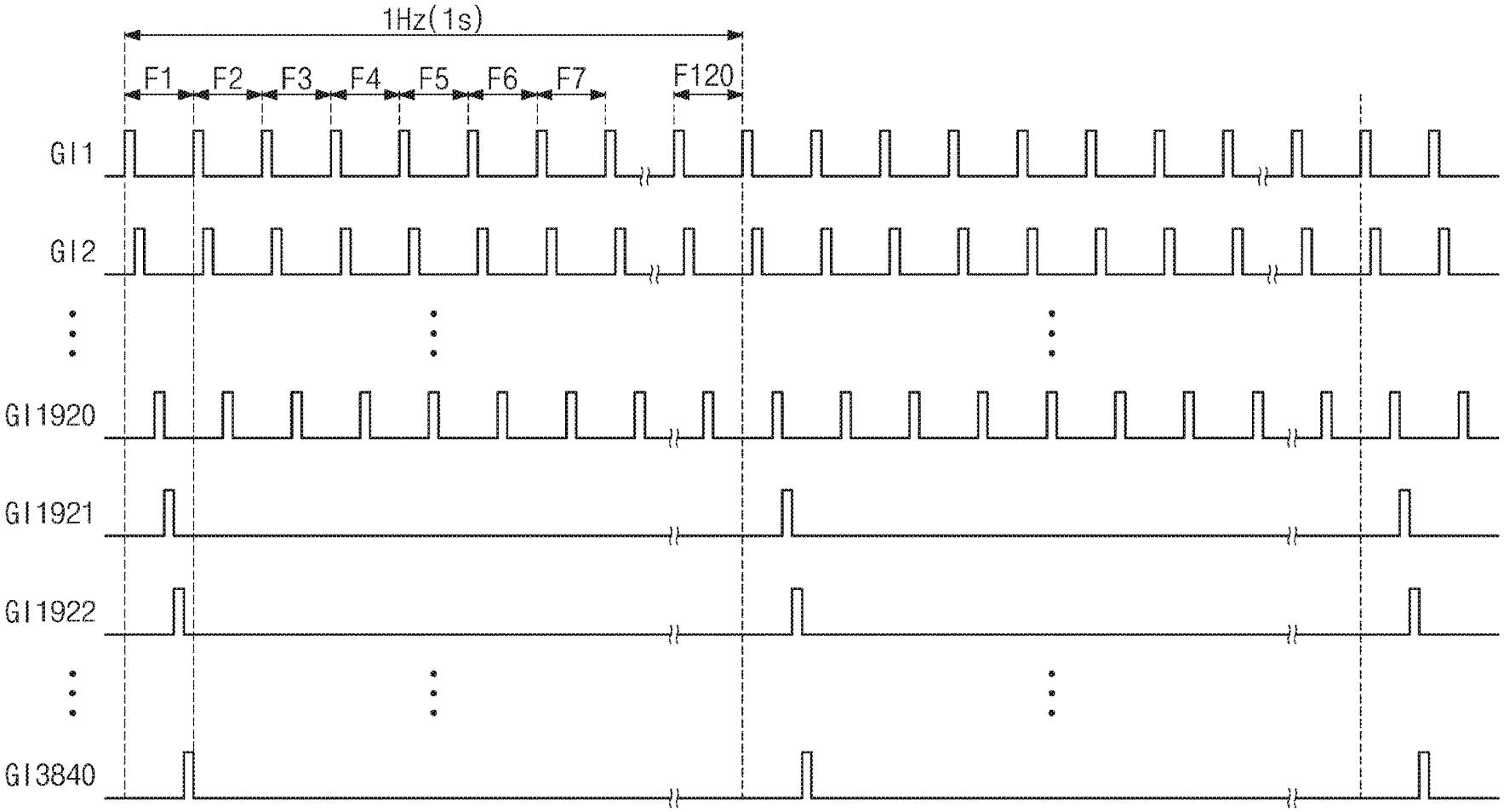
FIG. 8 shows scan signals in a multi-frequency mode.

FIG. 8 shows scan signals from GI1 to GI3840 in the multi-frequency mode MFM.

Referring to FIG. 8, the scan driving circuit SD (see FIG. 4) may output scan signals to the scan lines GIL1 to GILn, GCL1 to GCLn, and GWL1 to GWLn+1 in response to the scan control signal SCS.

In the multi-frequency mode MFM, the frequency of scan signals from GI1 to GI1920 is 120 Hz, and the frequency of scan signals from GI1921 to GI3840 is 1 Hz.

For example, the scan signals from GI1 to GI1920 correspond to the first display region DA1 of the display device DD illustrated in FIG. 1, and the scan signals from GI1921 to GI3840 correspond to the second display region DA2 of the same.

The scan signals from GI1 to GI1920 may be activated to a high level in each of the first frame F1 to the 120-th frame F120, and the scan signals from GI1921 to GI3840 may be activated to a high level only in the first frame F1.

Therefore, the first display region DA1 in which a moving image is displayed may be driven by the scan signals from GI1 to GI1920 of a normal frequency (e.g., 120 Hz), and the second display region DA2 in which a still image is displayed may be driven by the scan signals from GI1921 to GI3840 of a low frequency (e.g., 1 Hz). Since only the second display region DA2 in which a still image is displayed is driven at a low frequency, power consumption may be reduced without the deterioration in display quality of the display device DD (see FIG. 1).

FIG. 7 illustrates only the scan signals from GI1 to GI3840. However, the scan driving circuit SD (see FIG. 4) and the light emission driving circuit EDC (see FIG. 4) may also generate scan signals GC1 to GC3840 and GW1 to GI3841 and light emission signals EM1 to EM3840 in a similar way of generating the scan signals from GI1 to GI3840.

As in the examples shown in FIG. 1 and FIG. 8, when the display device DD is operated for a long period of time in the multi-frequency mode MFM in which the difference in driving frequency between the first display region DA1 and the second display region DA2 is large, and then images of the same gray scale are displayed in the first display region DA1 and the second display region DA2, there may be a difference in luminance of the images displayed in the first display region DA1 and the second display region DA2. Such a difference in luminance may be visually recognized by a user.

Figure 9:
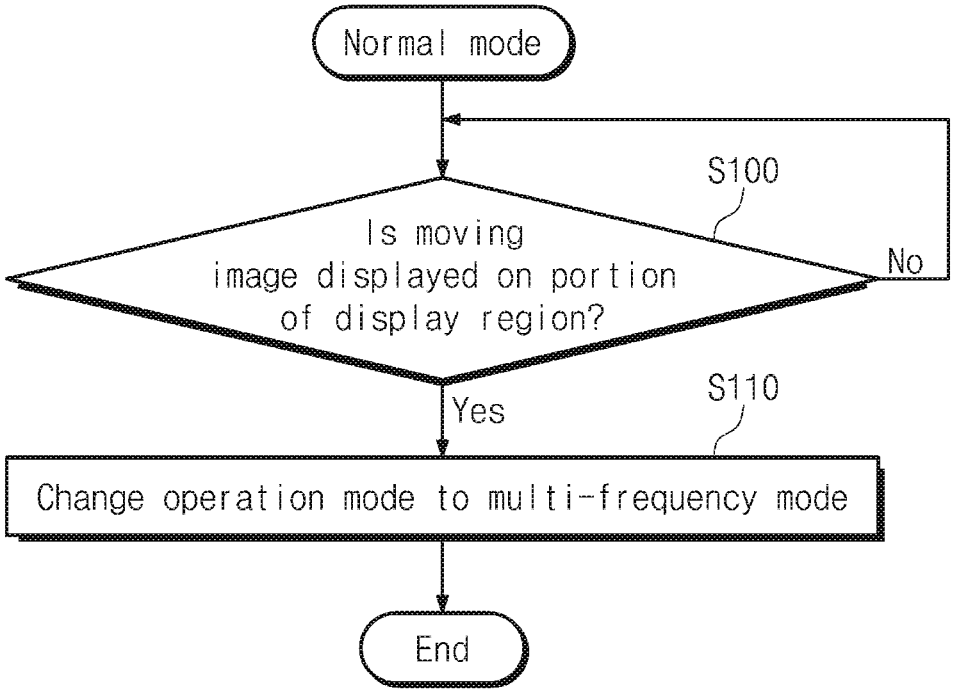
FIG. 9 is a flowchart showing the operation of a driving controller according to embodiment of the present disclosure.

FIG. 9 is a flowchart showing the operation of a driving controller according to embodiment of the present disclosure.

Referring to FIG. 7 and FIG. 9, the frequency mode determination part 110 of the driving controller 100 may initially set an operation mode to the normal mode NFM (e.g., after a power-up).

The frequency mode determination part 110 determines a frequency mode in response to the image signal RGB and the control signal CTRL. For example, when a portion of the image signal RGB of one frame (e.g., an image signal corresponding to the first display region DA1) is a moving image, and another portion thereof (e.g., an image signal corresponding to the second display region DA2) is a still image (step S100), the frequency mode determination part 110 changes the operation mode to the multi-frequency mode MFM and outputs a mode signal MD corresponding to the multi-frequency mode MFM (step S110).

Figure 10:
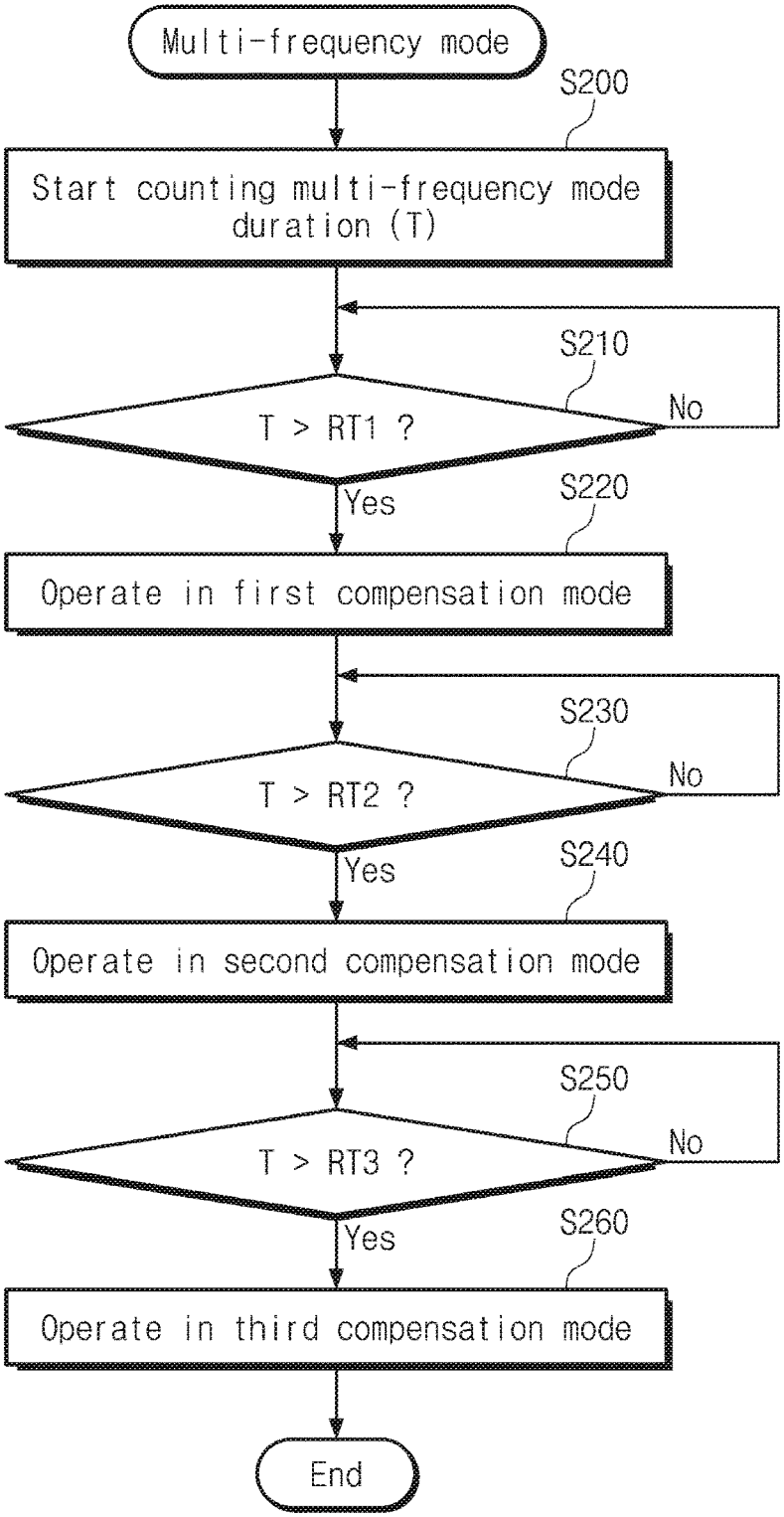
FIG. 10 is a flowchart showing the operation of a driving controller according to embodiment of the present disclosure in a multi-frequency mode MFM.

FIG. 10 is a flowchart showing the operation of a driving controller according to embodiment of the present disclosure in a multi-frequency mode MFM.

Referring to FIG. 1, FIG. 7, and FIG. 10, during the multi-frequency mode MFM, the first display region DA1 may be driven at a first driving frequency and the second display region DA2 may be driven at a second driving frequency lower than the first driving frequency.

When the multi-frequency mode MFM starts, the frequency mode determination part 110 starts counting a duration T of the multi-frequency mode MFM (step S200).

The frequency mode determination part 110 compares the duration T of the multi-frequency mode MFM with a first reference time RT1 (step S210).

When the duration T of the multi-frequency mode MFM is greater than the first reference time RT1, the frequency mode determination part 110 changes the operation mode to a first compensation mode ULF1 (see FIG. 11) and outputs a mode signal MD corresponding to the first compensation mode ULF1 (step S220).

Figure 11:
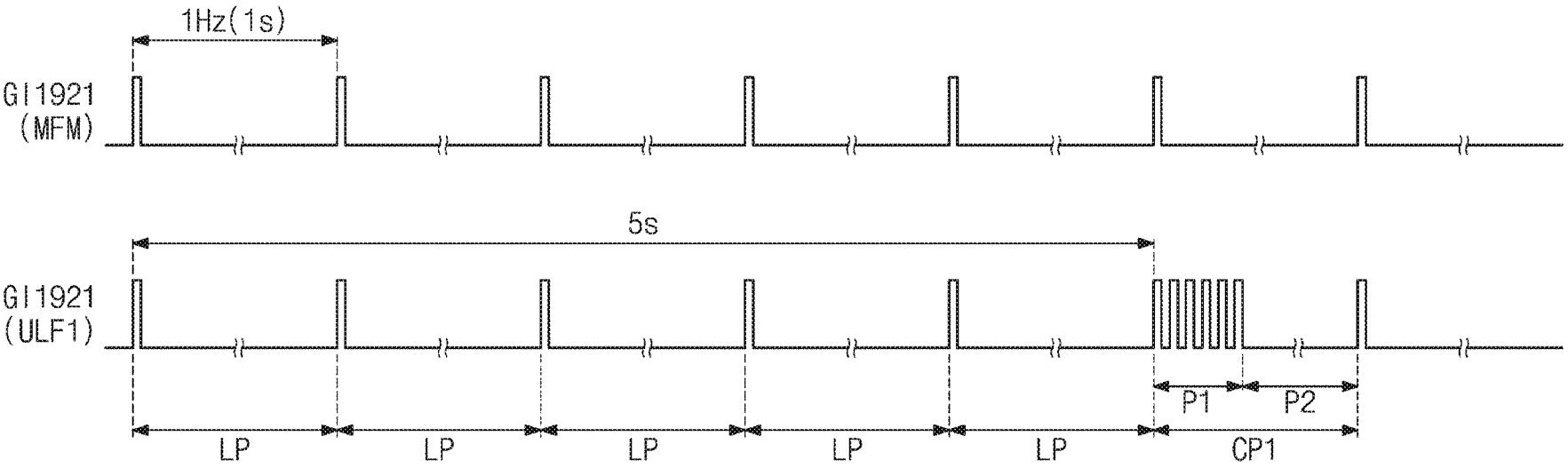
FIG. 11 shows a scan signal output from a scan driving circuit in each of a multi-frequency mode and a first compensation mode.

FIG. 11 shows a scan signal GI1921 output from a scan driving circuit in each of the multi-frequency mode MFM and the first compensation mode ULF1.

Figure 12:
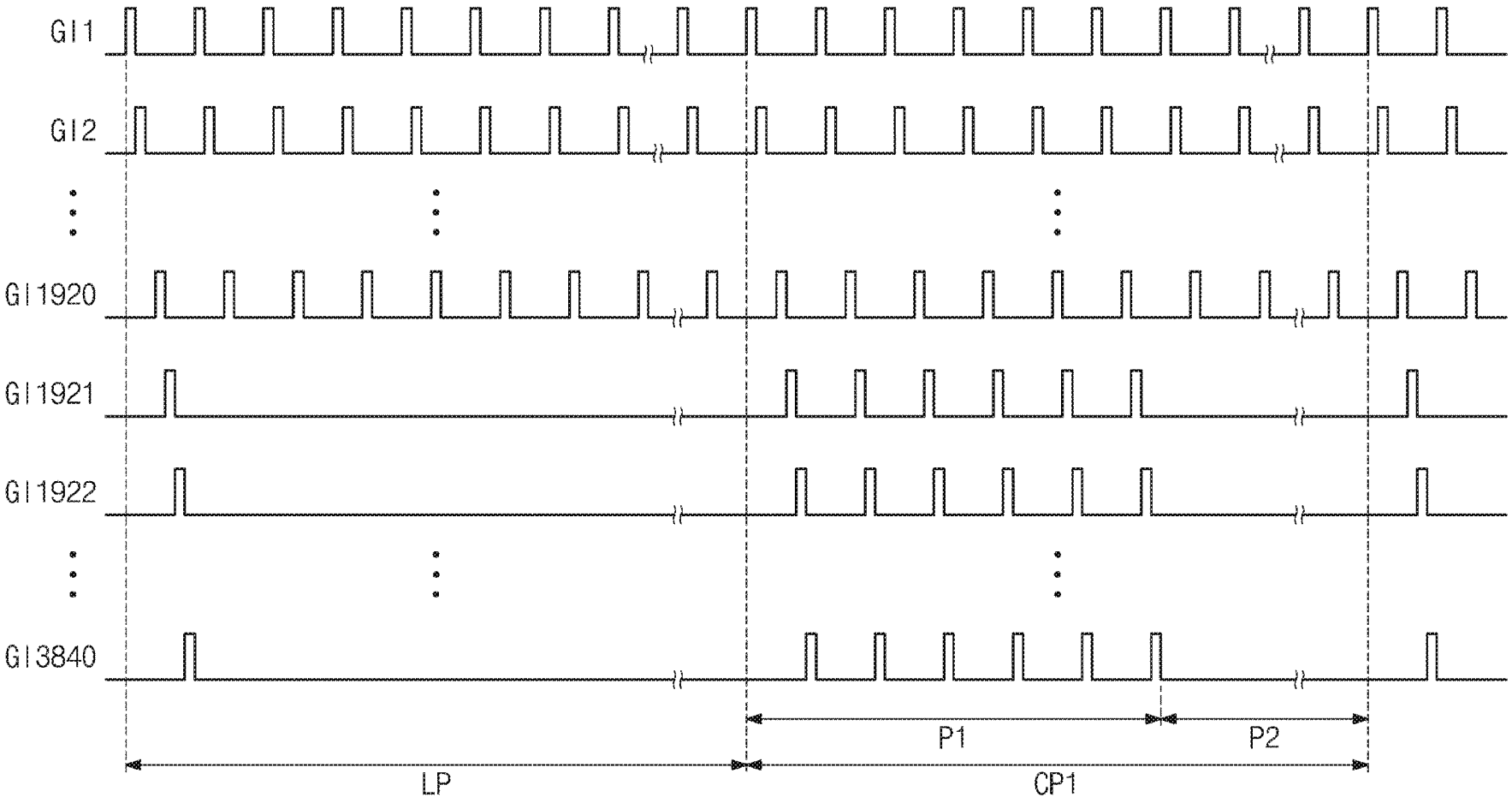
FIG. 12 is an enlarged view of a low-frequency period LP and a first compensation period illustrated in FIG. 11.

FIG. 12 is an enlarged view of the low-frequency period LP and a first compensation period CP1 illustrated in FIG. 11.

FIG. 11 illustrates only one scan signal GI1921 among the scan signals from GI1921 to GI3840 corresponding to the second display region DA2 (see FIG. 1), but the other scan signals from GI1922 to GI3840 corresponding to the second display region DA2 may also be driven in the same manner as the scan signal GI1921.

Referring to FIG. 1, FIG. 7, FIG. 8, and FIG. 11, during the multi-frequency mode MFM, the scan driving circuit SD may output the scan signal GI1921 to 1 Hz in response to the scan control signal SCS.

When the duration T of the multi-frequency mode MFM is less than or equal to the first reference time RT1, the frequency mode determination part 110 may maintain the operation mode as the multi-frequency mode MFM.

When the duration T of the multi-frequency mode MFM is greater than the first reference time RT1, the frequency mode determination part 110 changes the operation mode to the first compensation mode ULF1 and outputs the mode signal MD corresponding to the first compensation mode ULF1.

The signal generator 120 drives the second display region DA2 at the second driving frequency during the first compensation mode ULF1, but may output the image data signal DATA, the data control signal DCS, the light emission control signal ECS, and the scan control signal SCS to periodically drive the second display region DA2 at the first driving frequency.

The scan driving circuit SD (see FIG. 4) outputs the scan signals from GI1921 to GI3840 (see FIG. 8) of the second driving frequency during the first compensation mode ULF1, but may periodically output the scan signals from GI1921 to GI3840 of the first driving frequency.

For example, as illustrated in FIG. 11, the scan signal GI1921 includes the low-frequency periods LP and the first compensation period CP1 during the first compensation mode ULF1. The scan signal GI1921 may include the first compensation period CP1 every predetermined time (e.g., every 5 seconds). During the low-frequency periods LP, the driving frequency of the scan signal GI1921 is the second driving frequency (e.g., 1 Hz).

The first compensation period CP1 includes a first period P1 and a second period P2. During the first period P1, the driving frequency of the scan signal GI1921 is the first driving frequency (e.g., 120 Hz), and during the second period P2, the scan signal GI1921 may be maintained in an inactive state (e.g., low level).

As illustrated in FIG. 12, in the first period P1 of the first compensation period CP1, the scan signals from GI1 to GI3840 may be sequentially driven at the first driving frequency of 120 Hz. In the second period P2 of the first compensation period CP1, scan signals from GI1 to GI920 may be sequentially driven at the first driving frequency of 120 Hz, and the scan signal from GI1921 to GI3840 may be maintained in an inactive state (e.g., low level).

When the operation time (or the duration T) of the multi-frequency mode MFM increases (T>RT1), as illustrated in FIG. 11 and FIG. 12, the display device DD may drive the second display region DA2 in the first compensation mode ULF1. By periodically driving the second display region DA2 at a first driving frequency in the first compensation mode ULF1, it is possible to reduce an afterimage deviation caused by the difference in driving frequency between the first display region DA1 and the second display region DA2.

Referring back to FIG. 10, the frequency mode determination part 110 compares the duration T of the multi-frequency mode MFM with a second reference time RT2 (step S230).

When the duration T of the multi-frequency mode MFM is greater than the second reference time RT2, the frequency mode determination part 110 changes the operation mode to a second compensation mode ULF2 (see FIG. 13) and outputs a mode signal MD corresponding to the second compensation mode ULF2 (step S240).

The second reference time RT2 may be greater than the first reference time RT1.

Figure 13:
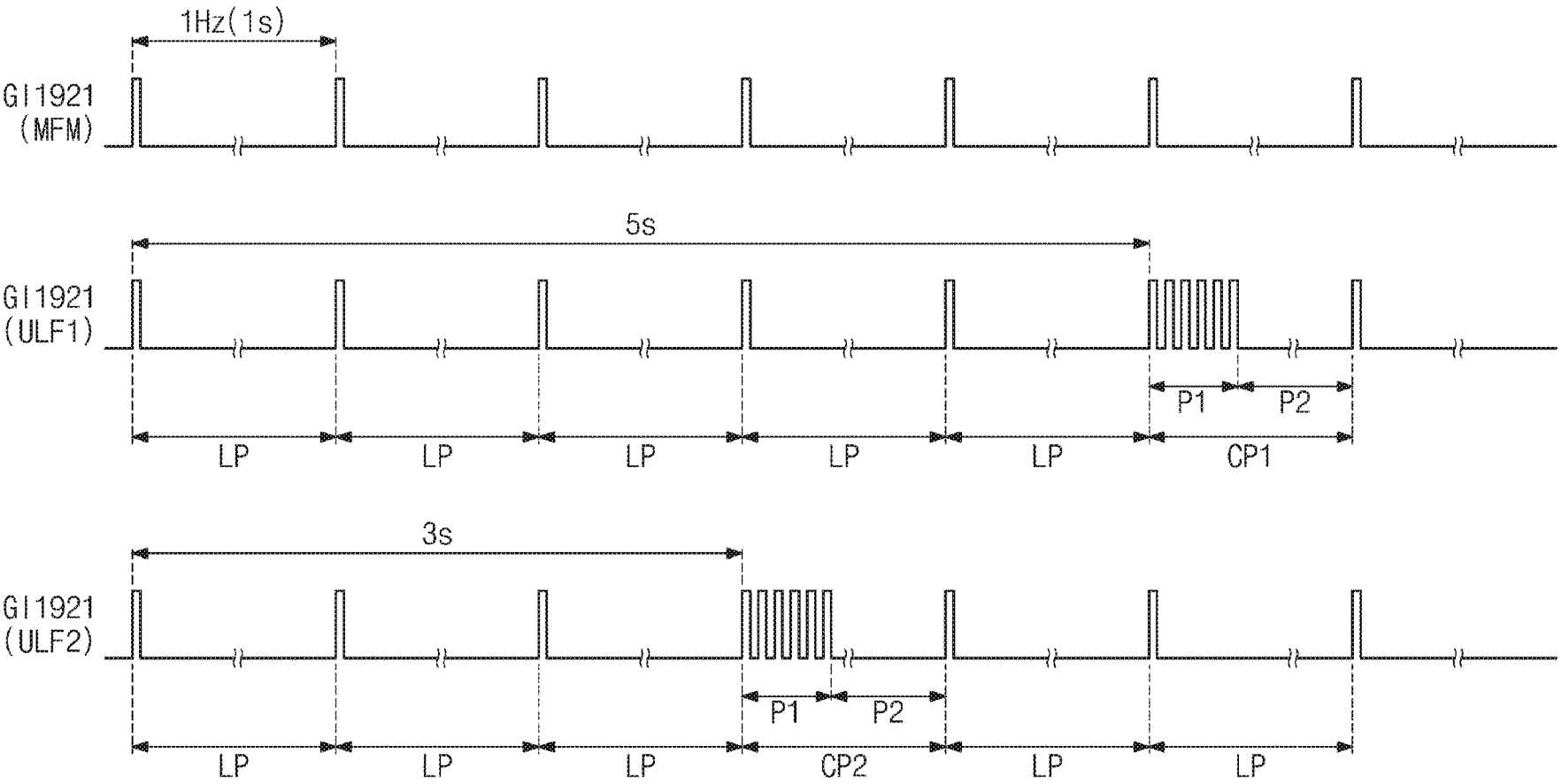
FIG. 13 shows a scan signal output from a scan driving circuit in each of a multi-frequency mode, a first compensation mode, and a second compensation mode.

FIG. 13 shows the scan signal GI1921 output from a scan driving circuit in each of the multi-frequency mode MFM, the first compensation mode ULF1, and the second compensation mode ULF2.

FIG. 13 illustrates only one scan signal GI1921 among the scan signals from GI1921 to GI3840 corresponding to the second display region DA2 (see FIG. 1), but the other scan signals from GI1922 to GI3840 corresponding to the second display region DA2 may also be driven in the same manner as the scan signal GI1921.

Referring to FIG. 1, FIG. 7, FIG. 8, and FIG. 13, during the multi-frequency mode MFM, the scan driving circuit SD may output the scan signal GI1921 to 1 Hz in response to the scan control signal SCS.

When the duration T of the multi-frequency mode MFM is less than or equal to the first reference time RT1, the frequency mode determination part 110 may maintain the operation mode as the multi-frequency mode MFM.

When the duration T of the multi-frequency mode MFM is greater than the first reference time RT1, the frequency mode determination part 110 changes the operation mode to the first compensation mode ULF1 and outputs the mode signal MD corresponding to the first compensation mode ULF1.

When the duration T of the multi-frequency mode MFM is greater than the second reference time RT2, the frequency mode determination part 110 changes the operation mode to the second compensation mode ULF2 and outputs the mode signal MD corresponding to the second compensation mode ULF2.

The signal generator 120 drives the second display region DA2 at a second driving frequency during the second compensation mode ULF2, but may output the image data signal DATA, the data control signal DCS, the light emission control signal ECS, and the scan control signal SCS to periodically drive the second display region DA2 at a first driving frequency.

The scan driving circuit SD (see FIG. 4) outputs the scan signals from GI1921 to GI3840 (see FIG. 8) of the second driving frequency during the second compensation mode ULF2, but may periodically output the scan signals from GI1921 to GI3840 of the first driving frequency.

For example, as illustrated in FIG. 13, the scan signal GI1921 includes the low-frequency periods LP and a second compensation period CP2 during the second compensation mode ULF2. The scan signal GI1921 may include the second compensation period CP2 every predetermined time (e.g., every 3 seconds). During the low-frequency periods LP, the driving frequency of the scan signal GI1921 is the second driving frequency (e.g., 1 Hz).

The second compensation period CP2 includes a first period P1 and a second period P2. During the first period P1, the driving frequency of the scan signal GI1921 is the first driving frequency (e.g., 120 Hz), and during the second period P2, the scan signal GI1921 may be maintained in an inactive state (e.g., low level).

Referring back to FIG. 10, the frequency mode determination part 110 compares the duration T of the multi-frequency mode MFM with a third reference time RT3 (step S250).

When the duration T of the multi-frequency mode MFM is greater than the third reference time RT3, the frequency mode determination part 110 changes the operation mode to a third compensation mode ULF3 (see FIG. 14) and outputs a mode signal MD corresponding to the third compensation mode ULF3 (step S260).

The third reference time RT3 may be greater than the second reference time RT2.

When the operation time (or the duration T) of the multi-frequency mode MFM increases (T>RT2), as illustrated in FIG. 13, the display device DD may drive the second display region DA2 in the second compensation mode ULF2. A repetition period (3 seconds) of the second compensation period CP2 of the second compensation mode ULF2 is shorter than a repetition period (5 seconds) of the first compensation period CP1 of the first compensation mode ULF1.

As the operation time (or the duration T) of the multi-frequency mode MFM increases, it is possible to reduce an afterimage deviation caused by the difference in driving frequency between the first display region DA1 and the second display region DA2 by reducing the repetition period of a compensation period.

Figure 14:
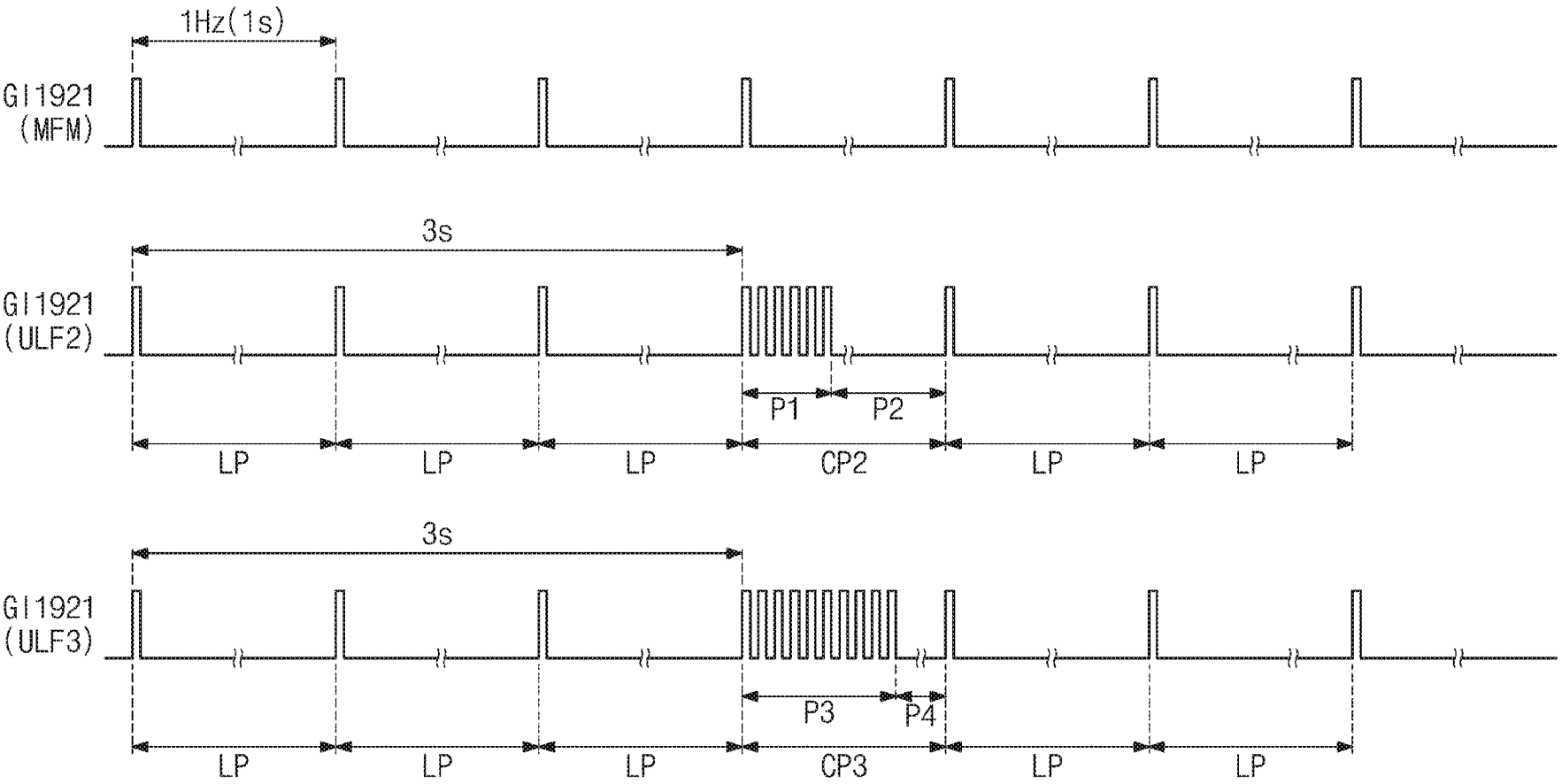
FIG. 14 shows a scan signal output from a scan driving circuit in each of a multi-frequency mode, a second compensation mode, and a third compensation mode.

FIG. 14 shows the scan signal GI1921 output from a scan driving circuit in each of the multi-frequency mode MFM, the second compensation mode ULF2, and the third compensation mode ULF3.

FIG. 14 illustrates only one scan signal GI1921 among the scan signals from GI1921 to GI3840 corresponding to the second display region DA2 (see FIG. 1), but the other scan signals from GI1922 to GI3840 corresponding to the second display region DA2 may also be driven in the same manner as the scan signal GI1921.

Referring to FIG. 1, FIG. 7, FIG. 8, and FIG. 14, during the multi-frequency mode MFM, the scan driving to the SD may output the scan signal GI1921 to 1 Hz in response to the scan control signal SCS.

When the duration T of the multi-frequency mode MFM is less than or equal to the first reference time RT1, the frequency mode determination part 110 may maintain the operation mode as the multi-frequency mode MFM.

When the duration T of the multi-frequency mode MFM is greater than the first reference time RT1, the frequency mode determination part 110 changes the operation mode to a first compensation mode ULF1 (see FIG. 13) and outputs a mode signal MD corresponding to the first compensation mode ULF1.

When the duration T of the multi-frequency mode MFM is greater than the second reference time RT2, the frequency mode determination part 110 changes the operation mode to the second compensation mode ULF2 and outputs the mode signal MD corresponding to the second compensation mode ULF2.

When the duration T of the multi-frequency mode MFM is greater than the third reference time RT3, the frequency mode determination part 110 changes the operation mode to the third compensation mode ULF3 and outputs a mode signal MD corresponding to the third compensation mode ULF3.

The signal generator 120 drives the second display region DA2 at a second driving frequency during the third compensation mode ULF3, but may output the image data signal DATA, the data control signal DCS, the light emission control signal ECS, and the scan control signal SCS to periodically drive the second display region DA2 at a first driving frequency.

The scan driving circuit SD (see FIG. 4) outputs the scan signals from GI1921 to GI3840 (see FIG. 8) of the second driving frequency during the third compensation mode ULF3, but may periodically output the scan signals from GI1921 to GI3840 of the first driving frequency.

For example, as illustrated in FIG. 14, the scan signal GI1921 includes the low-frequency periods LP and a third compensation period CP3 during the third compensation mode ULF3. The scan signal GI1921 may include the second compensation period CP2 every predetermined time (e.g., every 3 seconds). During the low-frequency periods LP, the driving frequency of the scan signal GI1921 is the second driving frequency (e.g., 1 Hz).

The third compensation period CP3 includes a third period P3 and a fourth period P4. During the third period P3, the driving frequency of the scan signal GI1921 is the first driving frequency (e.g., 120 Hz), and during the second period P4, the scan signal GI1921 may be maintained in an inactive state (e.g., low level). The duration of the third period P3 in the third compensation period CP3 may be longer than the duration of the first period P1 in the second compensation period CP2.

When the operation time (or the duration T) of the multi-frequency mode MFM increases (T>RT3), as illustrated in FIG. 14, the display device DD may drive the second display region DA2 in the third compensation mode ULF3. The repetition period (3 seconds) of the third compensation period CP3 of the second compensation mode ULF3 may be the same as the repetition period (3 seconds) of the second compensation period CP2 of the second compensation mode ULF2. However, the duration of the third period P3 in the third compensation period CP3 is longer than the duration of the first period P1 in the second compensation period CP2. As the operation time (or the duration T) of the multi-frequency mode MFM increases, it is possible to reduce an afterimage deviation caused by the difference in driving frequency between the first display region DA1 and the second display region DA2 by increasing the duration of the third period P3 in the third compensation period CP3.

Figure 15:
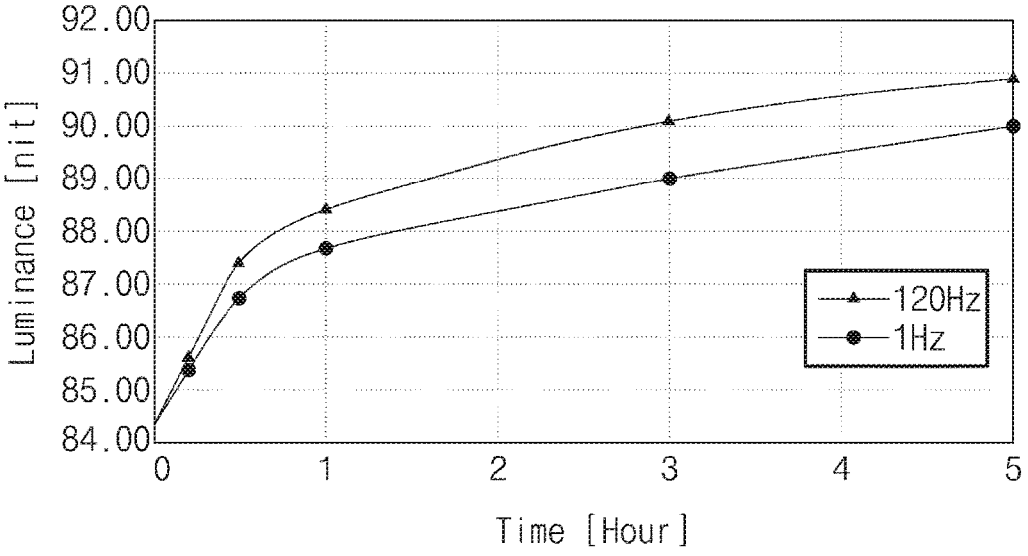
FIG. 15 is a graph showing the difference in luminance due to the afterimage of the first display region and the second display region.

FIG. 15 is a graph showing the difference in luminance due to the afterimage of the first display region and the second display region.

Figure 16:
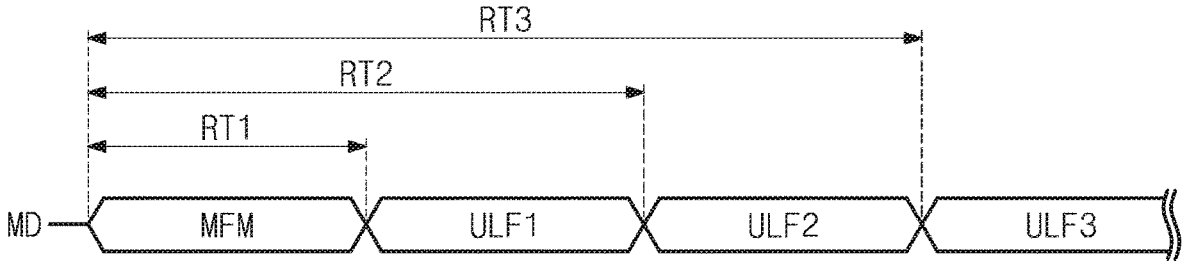
FIG. 16 shows a scan signal output from a scan driving circuit in each of a multi-frequency mode, a first compensation mode, a second compensation mode, and a third compensation mode.

FIG. 16 shows the scan signal GI1921 output from a scan driving circuit in each of the multi-frequency mode MFM, the first compensation mode ULF1, the second compensation mode ULF2, and the third compensation mode ULF3.

Referring to FIG. 1 and FIG. 15, in the multi-frequency mode MFM, the first display region DA1 may be driven at a first driving frequency of 120 Hz, and the second display region DA2 may be driven at a second driving frequency of 1 Hz. After a predetermined period of time, when an image of a predetermined gray scale (e.g., 128 gray scale) is simultaneously displayed on both the first display region DA1 and the second display region DA2, the difference in luminance between the first display region DA1 and the second display region DA2 is generated.

At the initial stage of the multi-frequency mode MFM, for example, until 20 minutes elapses, the difference in luminance between the first display region DA1 and the second display region DA2 may not be recognized by a user.

As illustrated in FIG. 15, it can be seen that the difference in luminance between the first display region DA1 and the second display region DA2 increases as the operation time (or the duration T) of the multi-frequency mode MFM increases.

Therefore, at the initial stage of the multi-frequency mode MFM, for example, until 20 minutes elapses, the frequency of the second display region DA2 in which a still image is displayed is maintained at a second driving frequency by maintaining the multi-frequency mode MFM. As the frequency of the second display region DA2 is maintained at a second driving frequency, it is possible to minimize power consumed in the display device DD.

When the operation time (or duration) of the multi-frequency mode MFM is less than or equal to the first reference time RT1, the frequency mode determination part 110 (see FIG. 7) outputs a mode signal MD corresponding to the multi-frequency mode MFM.

When the operation time (or duration) of the multi-frequency mode MFM is less than or equal to the second reference time RT2, the frequency mode determination part 110 (see FIG. 7) outputs a mode signal MD corresponding to the first compensation mode ULF1.

When the operation time (or duration) of the multi-frequency mode MFM is less than or equal to the third reference time RT3, the frequency mode determination part 110 (see FIG. 7) outputs a mode signal MD corresponding to the second compensation mode ULF2.

When the operation time (or duration) of the multi-frequency mode MFM is greater than the third reference time RT3, the frequency mode determination part 110 (see FIG. 7) outputs a mode signal MD corresponding to the third compensation mode ULF3.

Although not illustrated in the drawings, when the operation time (or duration) of the multi-frequency mode MFM is greater than a fourth reference time, the frequency mode determination part 110 (see FIG. 7) may terminate the multi-frequency mode MFM and output a mode signal MD corresponding to a normal mode.

The first reference time RT1 may be calculated based on Equation 1 below.

$$\Delta(LM1-LM2)/JND<M \quad \text{[Equation 1]}$$

In Equation 1, LM1 is luminance of the first display region DA1, LM2 is luminance of the second display region DA2, JND is just noticeable difference in luminance which may be sensed by a user, and M is a margin. For example, a margin M may be 0.8.

That is, the time when the ratio of the difference in luminance between the first display region DA1 and the second display region DA2 and JND reaches 0.8 may be set as the first reference time RT1.

The first reference time RT1, the second reference time RT2, and the third reference time RT3 may have a relationship of RT1<RT2<RT3. A difference value between the first reference time RT1 and the second reference time RT2 and a difference value between the second reference time RT2 and the third reference time RT3 may be the same or different from each other.

Referring to the graph illustrated in FIG. 15, the first reference time RT1 may be set to 30 minutes, the second reference time RT2 may be set to 1 hour, and the third reference time RT3 may be set to 3 hours.

When a moving image is displayed in a first display region and a still image is displayed in a second display region, a display device having the above configuration may be driven in a multi-frequency mode in which the first display region is driven at a first driving frequency and the second display region is driven at a second driving frequency. When the operation duration of the multi-frequency mode increases, the display device may drive the second display region in a compensation mode to minimize an afterimage deviation between the first display region and the second display region caused by the difference in driving frequency. Although the present disclosure has been described with reference embodiments of the present disclosure, it will be understood by those skilled in the art that various modifications and changes in form and details may be made therein without departing from the spirit and scope of the present disclosure as set forth in the following claims. In addition, the embodiments disclosed in the present disclosure are not intended to limit the technical spirit of the present disclosure, and all technical concepts falling within the scope of the following claims and equivalents thereof are to be construed as being included in the scope of the present disclosure.

What is claimed is:

1. A display device comprising:

a display panel including a plurality of pixels each connected to at least one of a plurality of data lines and one of a plurality of scan lines respectively;

a data driving circuit configured to drive the plurality of data lines;

a scan driving circuit configured to drive the plurality of scan lines; and a driving controller configured to alternatively determine an operation mode between a normal mode and a multi-frequency mode and configured to control the data driving circuit and the scan driving circuit in order to drive a first display region of the display panel at a first driving frequency and drive a second display region of the display panel at a second driving frequency while the operation mode is the multi-frequency mode, wherein the driving controller is configured to change the operation mode to a compensation mode in which the second display region is periodically driven at the first driving frequency when a duration of the multi-frequency mode is greater than a duration of a reference time.

2. The display device of claim 1, wherein the driving controller is configured to control the data driving circuit and the scan driving circuit to drive each of the first display region and the second display region at a normal frequency while the operation mode is the normal mode.

3. The display device of claim 2, wherein the first driving frequency is a same as the normal frequency.

4. The display device of claim 1, wherein the driving controller includes:

a frequency mode determination part configured to determine the operation mode based on an input signal including an image signal and a control signal, and to output a mode signal; and a signal generator configured to output a data control signal and a scan control signal corresponding to the mode signal, wherein the data control signal is provided to the data driving circuit, and the scan control signal is provided to the scan driving circuit.

5. The display device of claim 4, wherein:

when the duration of the multi-frequency mode is greater than a duration of a first reference time, the frequency mode determination part selects a first compensation mode as the operation mode in which the second display region is periodically driven at the first driving frequency, the scan driving circuit generates scan signals to be provided to the plurality of scan lines in response to the scan control signal, and a scan signal provided to a scan line corresponding to the second display region among the plurality of scan lines during the first compensation mode includes a low-frequency period and a first compensation period.

6. The display device of claim 5, wherein:

the first compensation period comprises a first period and a second period;

a driving frequency of the scan signal during the first period of the first compensation period is the first driving frequency; and the scan signal is maintained at an inactive level during the second period of the first compensation period.

7. The display device of claim 5, wherein a driving frequency of the scan signal during the low-frequency period is the second driving frequency.

8. The display device of claim 5, wherein:

when the duration of the multi-frequency mode is greater than a duration of a second reference time, the frequency mode determination part selects a second compensation mode as the operation mode in which the second display region is periodically driven at the first driving frequency; and a scan signal provided to a scan line corresponding to the second display region among the plurality of scan lines during the second compensation mode includes a low-frequency period and a second compensation period.

9. The display device of claim 8, wherein:

the duration of the second reference time is greater than the duration of the first reference time; and in the scan signal, a repetition period of the second compensation period is shorter than a repetition period of the first compensation period.

10. The display device of claim 8, wherein:

when the duration of the multi-frequency mode is greater than a duration of a third reference time, the frequency mode determination part selects a third compensation mode as the operation mode in which the second display region is periodically driven at the first driving frequency; and a scan signal provided to a scan line corresponding to the second display region among the plurality of scan lines during the third compensation mode includes a low-frequency period and a third compensation period.

11. The display device of claim 10, wherein:

the duration of the third reference time is greater than the duration of the second reference time; and in the scan signal, a repetition period of the third compensation period is shorter than a repetition period of the first compensation period.

12. The display device of claim 10, wherein:

the second compensation period comprises a first period and a second period;

the third compensation period comprises a third period and a fourth period;

in each of the first period of the second compensation period and the third period of the third compensation period, a driving frequency of the scan signal is the first driving frequency;

in each of the second period of the second compensation period and the fourth period of the third compensation period, the scan signal is maintained at an inactive level; and the third period of the third compensation period is longer than the first period of the second compensation period.

13. The display device of claim 1, wherein an input signal includes an image signal and a control signal.

14. A display device comprising:

a display panel having a first non-folding region, a folding region, and a second non-folding region which are defined on a plane and including a plurality of pixels each connected to a plurality of data lines and a plurality of scan lines;

a data driving circuit configured to drive the plurality of data lines;

a scan driving circuit configured to drive the plurality of scan lines; and a driving controller configured to alternatively determine an operation mode between a normal mode and a multi-frequency mode based on an input signal, and configured to control the data driving circuit and the scan driving circuit in order to drive a first display region of the display panel at a first driving frequency and drive a second display region of the display panel at a second driving frequency while the operation mode is the multi-frequency mode, wherein the driving controller is configured to change the operation mode to a compensation mode in which the second display region is periodically driven at the first driving frequency when a duration of the multi-frequency mode is greater than a duration of a reference time.

15. The display device of claim 14, wherein:

the first non-folding region corresponds to the first display region;

the second non-folding regions corresponds to the second display region; and a first portion of the folding region corresponds to the first display region, and a second portion of the folding region corresponds to the second display region.

16. The display device of claim 14, wherein the scan driving circuit generates scan signals to be provided to the plurality of scan lines in response to a scan control signal, and wherein a scan signal provided to a scan line corresponding to the second display region among the plurality of scan lines during the compensation mode includes a low-frequency period and a compensation period.

17. The display device of claim 16, wherein:

the compensation period includes a first period and a second period;

a driving frequency of the scan signal during the first period of the compensation period is the first driving frequency;

the scan signal is maintained at an inactive level during the second period of the compensation period; and a driving frequency of the scan signal during the low-frequency period is the second driving frequency.

18. A method for driving a display device, the method comprising steps of:

determining an operation mode based on an input signal between a normal mode and a multi-frequency mode;

driving a first display region at a first driving frequency such that a moving image is displayed in the first display region of a display panel and driving a second display region at a second driving frequency such that a still image is displayed in the second display region of the display panel while the operation mode is the multi-frequency mode;

counting a duration of the multi-frequency mode; and changing the operation mode to a first compensation mode in which the second display region is periodically driven at the first driving frequency when the duration is greater than a first reference time.

19. The method of claim 18, further comprising a step of:

generating scan signals to drive a plurality of scan lines of the display panel in response to an operation mode signal, wherein a scan signal provided to a scan line corresponding to the second display region among the plurality of scan lines during the first compensation mode includes a low-frequency period and a first compensation period.

20. The method of claim 19, wherein the first compensation period includes a first period and a second period, a driving frequency of the scan signal during the first period of the first compensation period is the first driving frequency, and the scan signal is maintained at an inactive level during the second period of the first compensation period.

* * * * *